US008347646B1

(12) United States Patent
Abraham, III

(10) Patent No.: US 8,347,646 B1
(45) Date of Patent: Jan. 8, 2013

(54) FROSTED BEVERAGE CHILLING AND DISPENSING DEVICE AND SYSTEM

(76) Inventor: Martin J. Abraham, III, Bogalusa, LA (US)

( * ) Notice: Subject to any disclaimer, the term of this patent is extended or adjusted under 35 U.S.C. 154(b) by 686 days.

(21) Appl. No.: 12/590,038

(22) Filed: Oct. 30, 2009

Related U.S. Application Data

(60) Provisional application No. 61/269,607, filed on Jun. 26, 2009, provisional application No. 61/217,524, filed on Jun. 1, 2009.

(51) Int. Cl.
*F25D 3/00* (2006.01)
*B67D 5/62* (2006.01)

(52) U.S. Cl. ..... 62/393; 222/146.6

(58) Field of Classification Search ..... 62/66, 98, 62/235, 258, 261, 340, 389, 390, 393, 399, 62/400, 434, 458, 460, 464; 222/132, 146.6, 222/183–184, 185.1, 185.2, 185.3
See application file for complete search history.

(56) References Cited

U.S. PATENT DOCUMENTS

| | | | | | |
|---|---|---|---|---|---|
| 2,515,367 | A | * | 7/1950 | Booker | 62/287 |
| 3,598,287 | A | * | 8/1971 | de Man | 222/94 |
| 4,189,928 | A | | 2/1980 | Cerny | |
| 4,306,616 | A | * | 12/1981 | Woods et al. | 165/136 |
| 4,351,157 | A | | 9/1982 | Zeigler | |
| 4,920,763 | A | * | 5/1990 | Provest et al. | 62/378 |
| 5,018,360 | A | | 5/1991 | Jones | |
| 5,456,387 | A | * | 10/1995 | Trewhella | 222/146.6 |
| 5,921,096 | A | * | 7/1999 | Warren | 62/185 |
| 5,970,734 | A | | 10/1999 | Stillwell et al. | |
| 6,327,864 | B1 | | 12/2001 | Crowe | |
| 6,351,963 | B2 | * | 3/2002 | Surber et al. | 62/246 |
| 6,363,733 | B1 | | 4/2002 | Galembeck | |
| 6,381,968 | B1 | | 5/2002 | O'Donoghue, Jr. et al. | |
| 6,460,375 | B1 | | 10/2002 | Lundaas | |
| 2008/0092578 | A1 | * | 4/2008 | Yeagy et al. | 62/261 |
| 2008/0098762 | A1 | * | 5/2008 | Kent | 62/258 |

* cited by examiner

*Primary Examiner* — Frantz Jules
*Assistant Examiner* — Emmanuel Duke
(74) *Attorney, Agent, or Firm* — Raymond D. Areaux; Ian C. Barras; Carver, Darden, Koretzky, Tessier, Finn, Blossman & Areaux, LLC

(57) ABSTRACT

According to an exemplary embodiment of the present invention, a device for chilling and dispensing a beverage from a bottle is provided. The device comprises mounting rail configured to attach to a bar top structure and having a top rail plate and a rail freezing and chilling mechanism under the top rail plate. The device also includes a dome configured to attach to the top rail plate and having a dome plate, interior storage tank and a dome freezing and chilling mechanism between the dome plate and the interior storage tank. The rail freezing and chilling mechanism and the dome freezing and chilling mechanism are configured to build a layer of frost on top of the top rail plate and along the dome plate from humidity of ambient air. The dome is configured to seat the bottle in an inverted position and chill and dispense the beverage from the interior storage tank.

14 Claims, 17 Drawing Sheets

FROSTED BEVERAGE CHILLING AND DISPENSING DEVICE AND SYSTEM

COPENDING APPLICATIONS

This application also claim priority benefit of Provisional Patent Application No. 61/217,524, filed Jun. 1, 2009, titled "FROSTED BEVERAGE CHILLING AND DISPENSING DEVICE AND SYSTEM" having the same inventor of the instant patent application and which is incorporated herein by reference as if set forth in full below. This application claims priority benefit of Provisional Patent Application No. 61/269,607 filed Jun. 26, 2009, titled "Multi-Configurable Frosted Bar Rail System" having the same inventor of the instant patent application and which is incorporated herein by reference as if set forth in full below.

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND

I. Field

The invention relates to beverage chilling and dispensing devices.

II. Background

In New York and other metropolitan areas, there are many clubs, restaurants and bar establishments in close vicinity that compete for patrons, some of which may simply walk by the storefront. Therefore, these businesses need a competitive edge. Thus, there is a need for restaurant, club and bar owners to provide accents, displays and other aesthetics which are trendy and attractive to catch a patron's interest.

A further challenge with accents, displays or other aesthetics is marrying such devices with usefulness as real estate is at a premium for a bar top. For example, when displaying liquor bottles on the bar, generally, such bottles or the contents therein are not also chilled in a manner which is aesthetically trendy and attractive. Such devices should also not encumber the employees when performing their jobs.

SUMMARY

The aforementioned problems, and other problems, are reduced, according to exemplary embodiments, by the frosted beverage chilling and dispensing device and system described herein.

According to an exemplary embodiment of the present invention, a device for chilling and dispensing a beverage from a bottle is provided. The device comprises mounting rail configured to attach to a bar top structure and having a top rail plate and a rail freezing and chilling mechanism under the top rail plate. The device also includes a dome configured to attach to the top rail plate and having a dome plate, interior storage tank and a dome freezing and chilling mechanism between the dome plate and the interior storage tank. The rail freezing and chilling mechanism and the dome freezing and chilling mechanism are configured to build a layer of frost on top of the top rail plate and along the dome plate from humidity of ambient air. The dome is configured to seat the bottle in an inverted position and chill and dispense the beverage from the interior storage tank.

The device according to the present invention comprises a plurality of domes and a plurality of dome lights arranged around a base of each dome. The plurality of dome lights are configured to illuminate the layer of frost on the domes and the mounting rail.

The device according to the present invention comprises a beer dispensing tower coupled to said mounting rail. The beer dispensing tower comprises a tower body wherein the tower body is configured to form a layer of frost on the tower body.

The device according to the present invention comprises a top rail plate and dome plate made of a metal having a first thermal conductivity factor. The rail freezing and chilling mechanism includes a first non-metallic thermal layer immediately below the top rail plate; a metal thermal conductor layer made of a metal with a second thermal conductivity factor greater than the first conductivity factor below the first non-metallic thermal layer; a second non-metallic thermal layer below the metal thermal conductor layer; and at least one refrigerant line partially or fully embedded within the second non-metallic thermal layer, the at least one refrigerant line being configured to flow therethrough a refrigerant.

The device according to the present invention includes a dome freezing and chilling mechanism that includes a first non-metallic thermal layer immediately concentric with the dome plate; a metal thermal conductor layer made of a metal with a third thermal conductivity factor greater than the first conductivity factor adjacent to and concentric with the first non-metallic thermal layer; a second non-metallic thermal layer adjacent to and concentric with the metal thermal conductor layer; and at least one refrigerant line partially or fully embedded within the second non-metallic thermal layer, the at least one refrigerant line being configured to flow therethrough a refrigerant.

The device according to the present invention includes a mechanism to control condensation.

In another embodiment, the present invention provides a system for chilling and dispensing a beverage from a bottle. The system comprises a chilling and frost system having a compressor and refrigerant. The system includes a mounting rail configured to attach to a bar top structure and having a top rail plate and a rail freezing and chilling mechanism under the top rail plate. The rail freezing and chilling mechanism is configured to receive the refrigerant. The system includes a dome configured to attach to the top rail plate and having a dome plate, interior storage tank and a dome freezing and chilling mechanism between the dome plate and the interior storage tank. The dome freezing and chilling mechanism is configured to receive the refrigerant. The rail freezing and chilling mechanism and the dome freezing and chilling mechanism are configured to build a layer of frost on top of the top rail plate and along the dome plate from humidity of ambient air and the dome is configured to seat the bottle in an inverted position and chill and dispense the beverage from the interior storage tank.

In another embodiment, the present invention provides a dome for chilling and dispensing a beverage from a bottle. The dome comprises an external dome plate having a top opening and an interior storage tank within the external dome plate. The dome further comprises a dome freezing and chilling mechanism between the external dome plate and the interior storage tank. The dome freezing and chilling mechanism is configured to receive a refrigerant to build a layer of frost on along the external dome plate from humidity of ambient air. The dome is configured to seat in the top opening the bottle in an inverted position and to chill and dispense the beverage from the interior storage tank.

Other systems, methods, and/or products according to embodiments will be or become apparent to one with skill in the art upon review of the following drawings, and further description. It is intended that all such additional systems, methods, and/or products be included within this description, be within the scope of the present invention, and be protected by the accompanying claims.

BRIEF DESCRIPTION OF THE DRAWINGS

The above and other exemplary embodiments, objects, uses, advantages, and novel features are more clearly understood by reference to the following description taken in connection with the accompanying figures wherein.

DESCRIPTION

Figure 1:
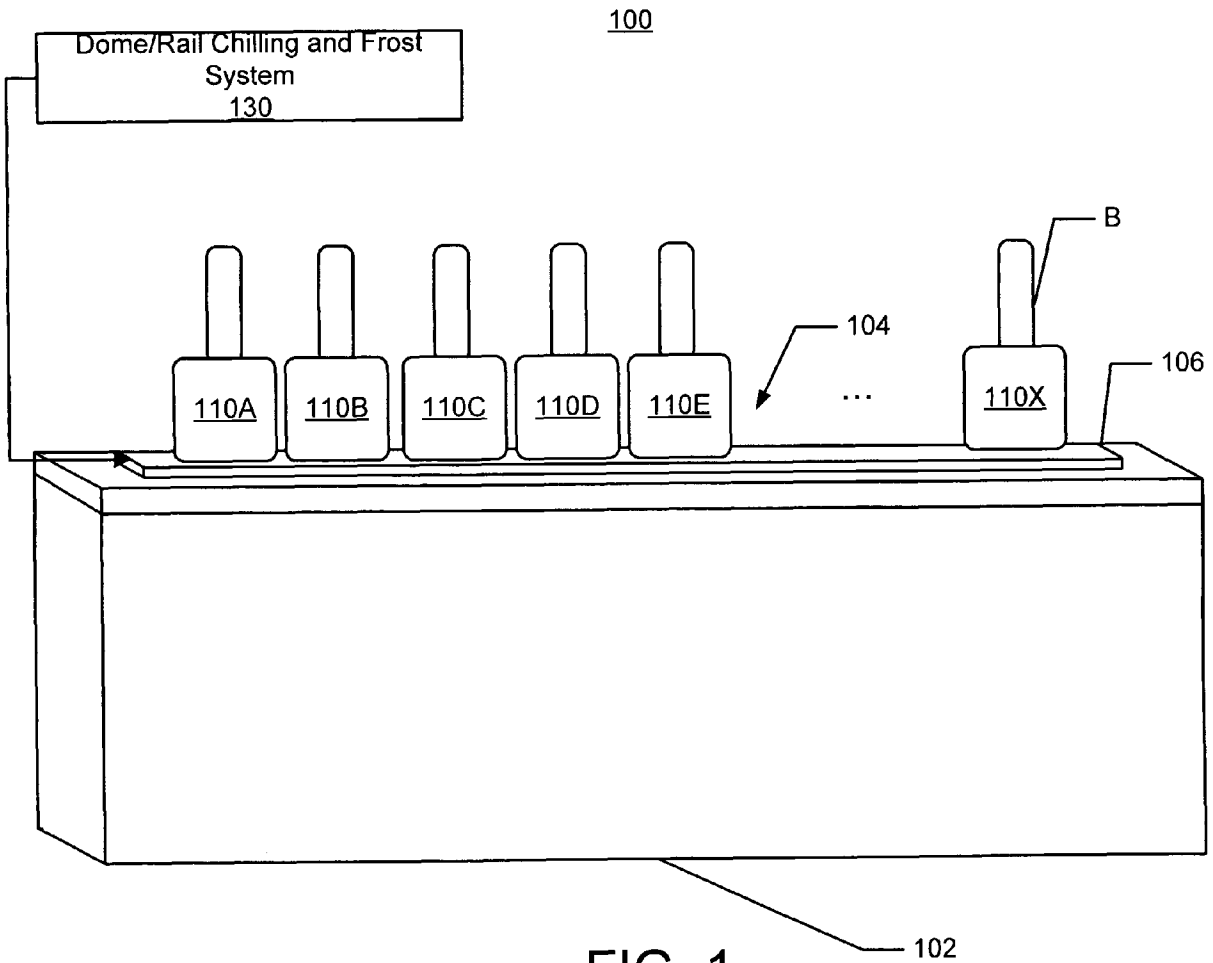
FIG. 1 illustrates a perspective view of the frosted beverage chilling and dispensing system installed on a stationary bar in accordance with some of the exemplary embodiments.

The word "exemplary" is used herein to mean "serving as an example, instance, or illustration." Any configuration or design described herein as "exemplary" is not necessarily to be construed as preferred or advantageous over other configurations or designs.

This invention now will be described more fully hereinafter with reference to the accompanying drawings, in which exemplary embodiments are shown. This invention may, however, be embodied in many different forms and should not be construed as limited to the embodiments set forth herein. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Within the descriptions of the figures, similar elements are provided similar names and reference numerals as those of the previous figure(s). Where a later figure utilizes the same element or a similar element in a different context or with different functionality, the element is provided a different leading numeral representative of the figure number (e.g., 1*xx* for FIGS. 1 and 2*xx* for FIG. 2). The specific numerals assigned to the elements are provided solely to aid in the description and not meant to imply any limitations (structural or functional) on the invention.

Thus, for example, it will be appreciated by those of ordinary skill in the art that the diagrams, schematics, illustrations, and the like represent conceptual views or perspective views illustrating some of the frosted beverage chilling and dispensing devices and frosted beverage chilling and dispensing systems of this invention. The functions of the various elements shown in the figures may vary in shape, attachment, size, and other physical features. Those of ordinary skill in the art further understand that the exemplary systems, and/or methods described herein are for illustrative purposes and, thus, are not intended to be limited to any particular named manufacturer or other relevant physical limitation (e.g., material).

The frosted beverage chilling and dispensing system in accordance with the present invention comprises a remote dome chilling and frost system coupled to a frosted beverage chilling and dispensing device. The frosted beverage chilling and dispensing device includes a frosted dome mounting rail with one or more frosted beverage chilling and dispensing domes configured to chill beverages within the dome. Each dome is configured to create snowy white frosted ice or frost evenly around and about its exterior perimeter wall surface. In an embodiment, the frosted beverage chilling and dispensing device may also include a frosted beer dispensing tower.

The frosted beverage chilling and dispensing device in accordance with one embodiment comprises at least one frosted beverage chilling and dispensing dome configured to chill liquor to a temperature within a predetermined range of cold temperatures.

The frosted beverage chilling and dispensing device is configured to dispense liquor from a vertically seated liquor bottle.

The frosted beverage chilling and dispensing device is configured to chill in and dispense liquor from a frosted beverage chilling and dispensing dome in the range of −5° to +5°.

In an exemplary embodiment, the frosted beverage chilling and dispensing device is a liquor beverage chiller and dispensing device that builds a layer of frost (snowy white frost) on an exterior perimeter surface of a dome and chills an interior liner of the dome to a temperature to chill the liquor beverage stored therein. The liquor is stored in direct contact with the interior liner.

In an embodiment, the frosted beverage chilling and dispensing dome has a cylindrical shape with a top mounted seat (centrally located) configured to seat a liquor bottle vertically upside down. Thus, liquor is dispensed from a vertically upside down bottle under gravity into the cavity of the interior liner. As the liquor is dispensed, the liquor remaining in the bottle is replaced in the cavity of the interior liner.

In an exemplary embodiment, the frosted beverage chilling and dispensing device comprises a means for illuminating the dome, the frost on the frosted beverage chilling and dispensing dome and/or the frost of the frosted beverage chilling and dispensing device.

In an exemplary embodiment, the frosted beverage chilling and dispensing dome comprises a cylindrically-shaped structure. Nonetheless, other geometric shaped structures can be used for the frosted beverage chilling and dispensing dome.

In an exemplary embodiment, the frosted beverage chilling and dispensing dome is configured to form white snowy like frost on the exterior perimeter surface in ambient or room temperatures associated with a dining room, bar or main lounge environment.

In an exemplary embodiment, the frosted beverage chilling and dispensing dome comprises a metal plate forming the dome with a central aperture in a top surface to seat a liquor bottle. The exterior surface of the metal plate forms frosted ice evenly and continuously thereon such that there are no gaps, strips or other discontinuities of ice or frost formations.

FIG. 1 illustrates a perspective view of the frosted beverage chilling and dispensing system 100 installed on a stationary bar 102 in accordance with some of the exemplary embodiments. The stationary bar 102 may be any bar found in a restaurant, lounge, bar, billiard room, etc. The system 100 includes one or more frosted beverage chilling and dispensing devices 104. Each device 104 includes a frosted dome mounting rail 106 with one or more frosted beverage chilling and dispensing domes 110A, 110B, 110C, 110D, 110E, . . . , 110X configured to chill beverages within the dome. Each frosted beverage chilling and dispensing dome 110A, 110B, 110C, 110D, 110E, . . . , 110X is configured to create snowy white frosted ice or frost evenly about its perimeter. Likewise, the frosted dome mounting rail 106 is configured to create snowy white frosted ice or frost evenly along its length.

Figure 3A:
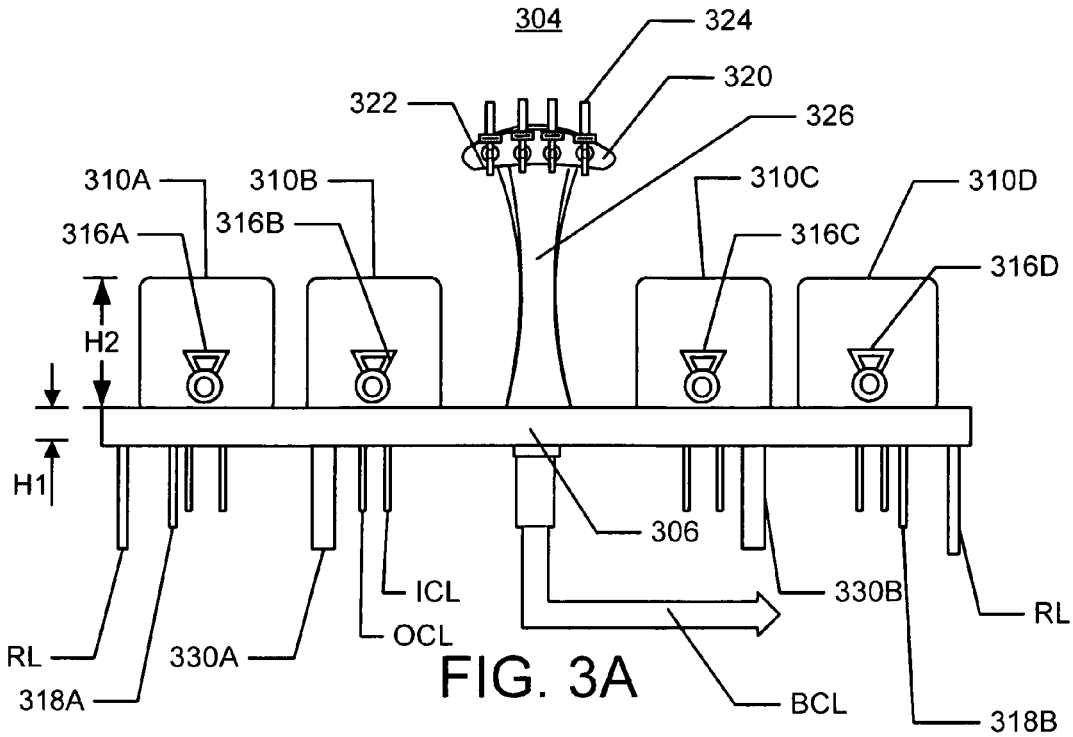
FIG. 3A illustrates a front schematic view of the frosted beverage chilling and dispensing device (without lights) in accordance with some of the exemplary embodiments.

Each frosted beverage chilling and dispensing dome 110A, 110B, 110C, 110D, 110E, . . . , 110X is configured to support a bottle B in an inverted position and dispense a beverage from the bottle B. In FIG. 1, the one or more frosted beverage chilling and dispensing domes 110A, 110B, 110C, 110D, 110E, . . . , 110X are shown on a side opposite that of the dispensing faucet (FIG. 3A).

The system 100 includes a dome/rail chilling and frost system 130 configured to deliver refrigerant to the frosted dome mounting rail 106 and the one or more frosted beverage chilling and dispensing domes 110A, 110B, 110C, 110D, 110E, . . . , 110X. The one or more frosted beverage chilling and dispensing domes 110A, 110B, 110C, 110D, 110E, . . . , 110X are configured to chill liquor to a temperature within a predetermined range of cold temperatures and dispense the liquor from a vertically seated liquor bottle B. For example, the frosted beverage chilling and dispensing device 104 is configured to chill in and dispense liquor from a dome 110A, 110B, 110C, 110D, 110E, . . . , 110X in the range of −5° to +5°.

Figure 6A:
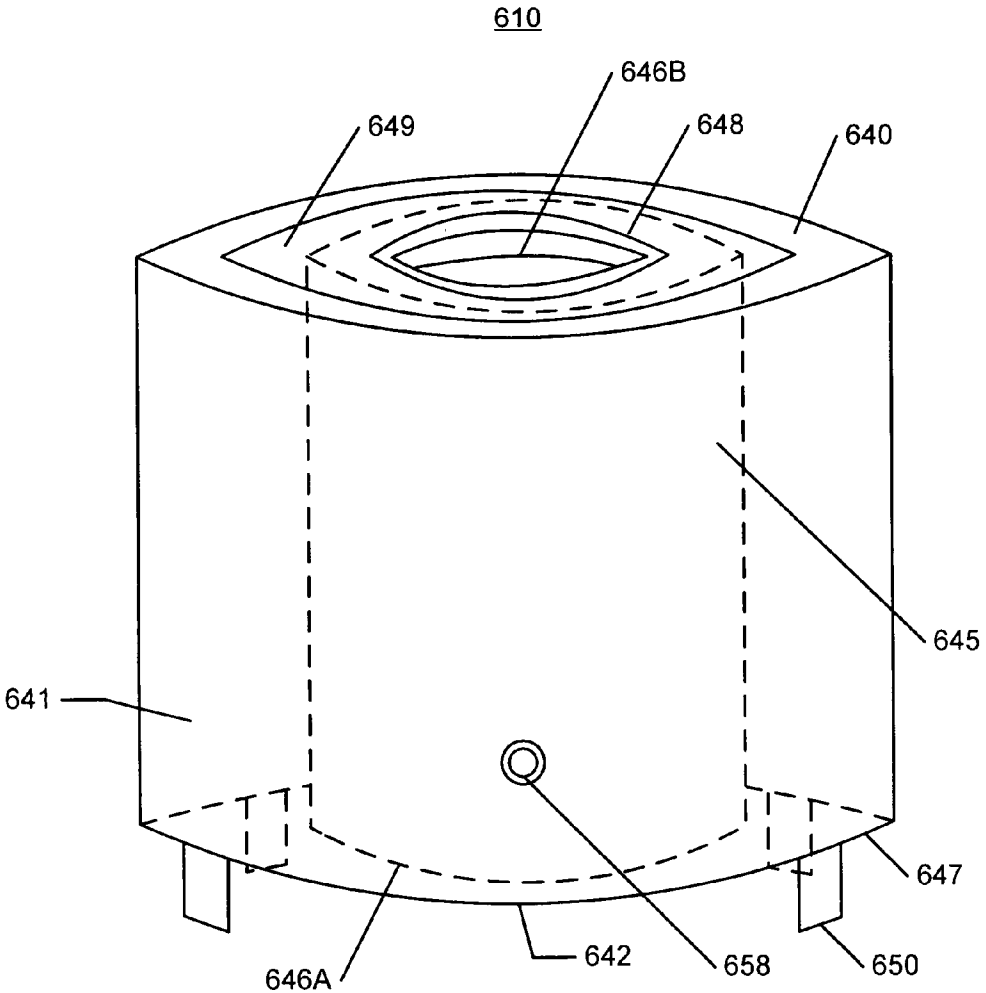
FIG. 6A illustrates a perspective view of a frosted beverage chilling and dispensing dome in accordance with some of the exemplary embodiments.
Figure 6B:
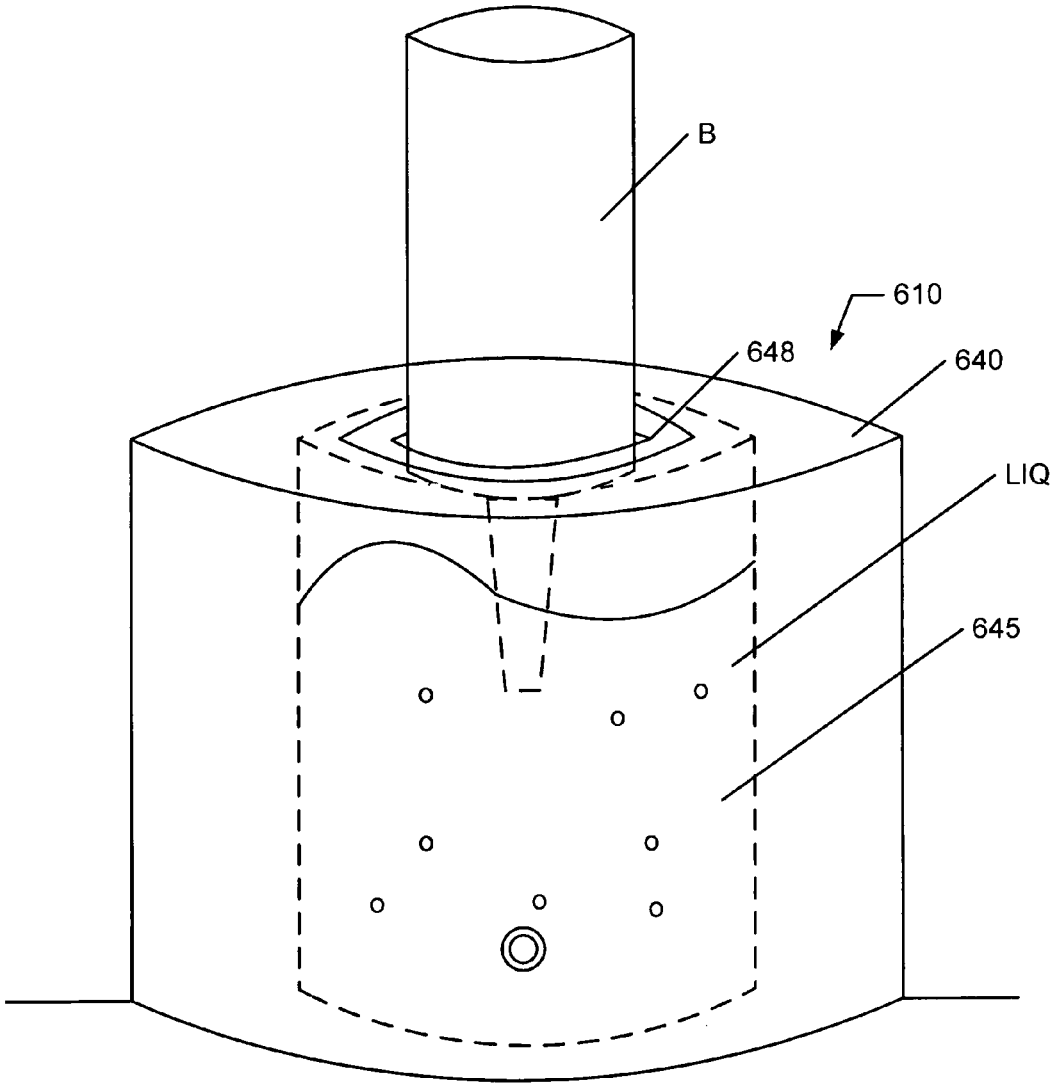
FIG. 6B illustrates a perspective view of a frosted beverage chilling and dispensing dome of FIG. 6A with a seated liquor bottle in accordance with some of the exemplary embodiments.

In an exemplary embodiment, the frosted beverage chilling and dispensing device 104 is a liquor beverage chiller and dispensing device that builds a layer of frost (snowy white frost) on an exterior perimeter surface of each dome 110A, 110B, 110C, 110D, 110E, . . . , 110X and chills an interior liner (FIGS. 6A-6B) of the dome to a temperature to chill the liquor or beverage stored therein. The liquor or beverage is stored in direct contact with the interior liner (FIG. 6).

In an embodiment, the frosted beverage chilling and dispensing dome 110A, 110B, 110C, 110D, 110E, . . . , 110X has a cylindrical shape with a top mounted seat (centrally located). The seat (FIGS. 6A-6B) is configured to seat a (liquor) bottle B vertically upside down (inverted). Thus, liquor is dispensed from a vertically upside down bottle B under gravity into the cavity of the interior liner (FIGS. 6A-6B). As the liquor or beverage is dispensed, the liquor or beverage remaining in the bottle B is replaced in the cavity of the interior liner (FIGS. 6A-6B).

The frosted beverage chilling and dispensing domes 110A, 110B, 110C, 110D, 110E, . . . , 110X may be constructed to have other geometric shapes other than a cylindrical shape. For example, the dome may have a pyramid shape, a spherical shape, circular shape, other geometric shapes or non-geometric shapes.

In an exemplary embodiment, the frosted beverage chilling and dispensing domes 110A, 110B, 110C, 110D, 110E, . . . , 110X are configured to form white snowy like frost on the exterior perimeter surface thereof in ambient or room temperatures associated with a dining room, bar or main lounge environment. The exterior perimeter surface forms frosted ice evenly and continuously thereon such that there are no gaps, strips or other discontinuities of ice or frost formations.

Figure 2:
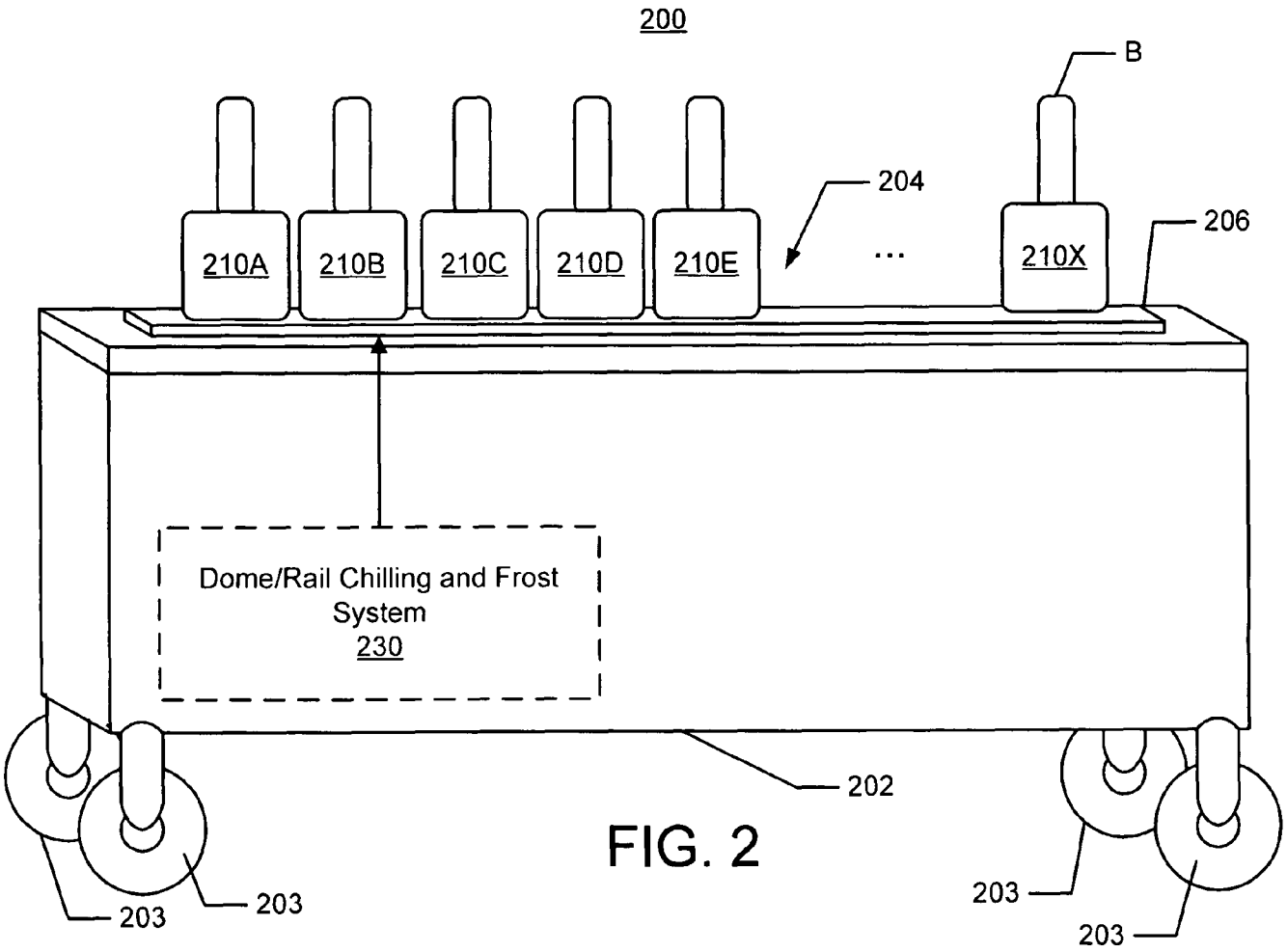
FIG. 2 illustrates a perspective view of the frosted beverage chilling and dispensing system integrated with a movable bar in accordance with some of the exemplary embodiments.

FIG. 2 illustrates a perspective view of the frosted beverage chilling and dispensing system 200 integrated with a movable bar 202 in accordance with some of the exemplary embodiments. The movable bar 202 includes four corners. Each corner has a wheel 203 coupled thereto to allow the bar 202 to be wheeled to a particular location. The movable bar 202 can be moved in and out of use. For example, the movable bar 202 may be positioned in a conference room, wedding hall, or other venues and connected to electricity and/or other utilities. Once the system 200 is turned on, the frosted beverage chilling and dispensing device 204 begins making frost or ice from the ambient air.

The system 200 includes one or more frosted beverage chilling and dispensing devices 204. Each device 204 includes a frosted dome mounting rail 206 with one or more frosted beverage chilling and dispensing domes 210A, 210B, 210C, 210D, 210E, . . . , 210X configured to chill beverages within the dome. Each frosted beverage chilling and dispensing dome 210A, 210B, 210C, 210D, 210E, . . . , 210X is configured to create snowy white frosted ice or frost evenly about its perimeter. Likewise, the frosted dome mounting rail 206 is configured to create snowy white frosted ice or frost evenly along its length.

Each frosted beverage chilling and dispensing dome 210A, 110B, 210C, 210D, 210E, . . . , 210X is configured to support a bottle B in an inverted position and dispense a beverage from the bottle B. In FIG. 2, the one or more frosted beverage chilling and dispensing domes 210A, 210B, 210C, 210D, 210E, . . . , 210X are shown on a side opposite that of the dispensing faucet (FIG. 3A), as will be described in detail later.

The system 200 includes a dome/rail chilling and frost system 230 mounted in the bar 202 and configured to deliver refrigerant to the frosted dome mounting rail 206 and the one or more frosted beverage chilling and dispensing domes 210A, 210B, 210C, 210D, 210E, . . . , 210X. The frosted beverage chilling and dispensing device 204 is configured to chill in and dispense liquor from a dome 210A, 210B, 210C, 210D, 210E, . . . , 210X in the range of −5° to +5°.

Figure 3B:
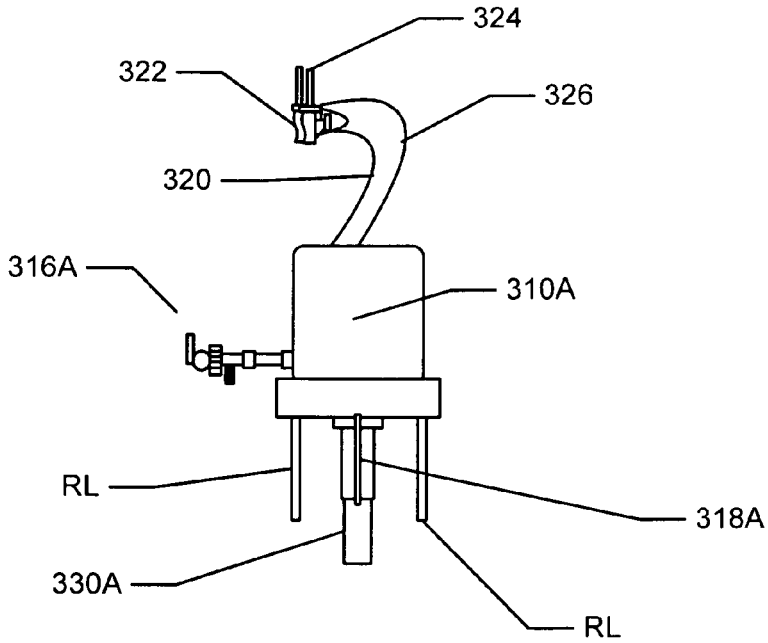
FIG. 3B illustrates a side schematic view of the frosted beverage chilling and dispensing device (without lights) in accordance with the embodiment of FIG. 3A.
Figure 3C:
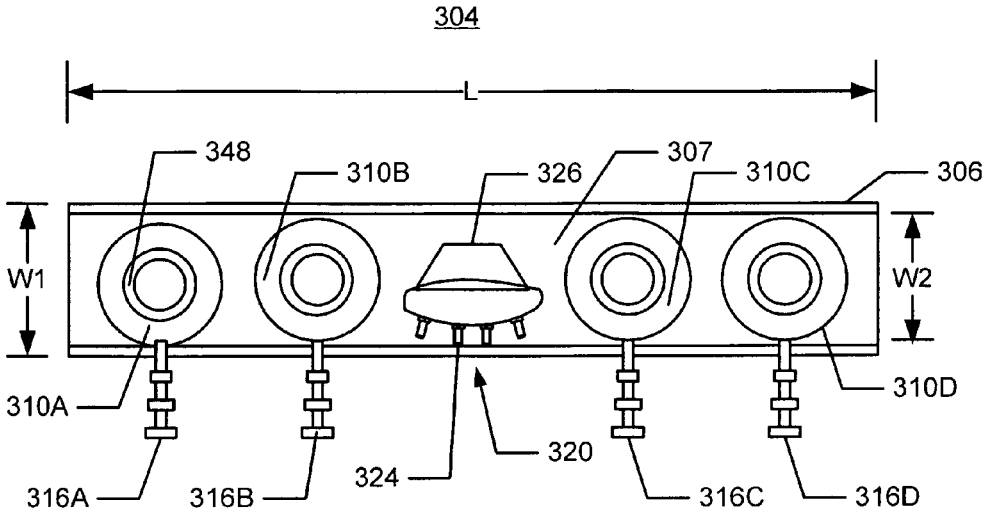
FIG. 3C illustrates a top schematic view of the frosted beverage chilling and dispensing device (without lights) in accordance with the embodiment of FIG. 3A.

FIGS. 3A-3C illustrates front, side and top schematic views of a frosted beverage chilling and dispensing device 304 (without lights) in accordance with some of the exemplary embodiments. The frosted beverage chilling and dispensing device 304 is shown with a frosted dome mounting rail 306. The frosted dome mounting rail 306 has a plurality of frosted beverage chilling and dispensing domes 310A, 310B, 310C and 310D mounted thereto and a frosted beer dispensing tower 320.

The frosted dome mounting rail 306 has mounted thereto four frosted beverage chilling and dispensing domes 310A, 310B, 310C and 310D. However, the frosted dome mounting rail 306 may have more or less domes mounted thereto. The length of the rail would determine the number of domes. In an embodiment, four domes 310A, 310B, 310C and 310D with a centrally positioned frosted beer dispensing tower 320 are provided with two domes on each side of the tower 320.

In an embodiment, the frosted beer dispensing tower 320 may be replaced with a fifth dome mounted to the frosted dome mounting rail 306. Nonetheless, the frosted dome mounting rail 306 may be configured to support one or more domes 310A, 310B, 310C and 310D with one or more beverage dispensing towers 320 that may dispense beer or other chilled beverages.

In an embodiment, the frosted beer dispensing tower 320 is configured to dispense therefrom beer at 32° F. However, the beer may be dispensed in the range of 27°-32°. The tower 320 has a plurality of dispensing heads 322 with levers 324. Each lever 324 or dispensing head 322 is configured to or is connected to a respective one beer or beverage line to dispense a single beverage product.

The domes 310A, 310B, 310C and 310D are configured to dispense a liquor beverage in the range of −5° to +5° for extremely cold temperatures. However, the liquor may be dispensed at other temperatures below −5° or above +5°. Each dome 310A, 310B, 310C and 310D includes a port 658 (FIG. 6A) having coupled thereto a dispensing faucet 316A, 316B, 316C and 316D, respectively. The faucets may have a 3⅝ or 5⅜ inch length.

As best seen in FIG. 3C, the frosted dome mounting rail 306 has a length L of approximately 48 inches and a width W1 of approximately 9¼ inches. A top rail plate 307 has a width W2 of approximately 8 inches on which frost or snowy white frosted ice is formed. The frosted dome mounting rail 306 also has a height H1 of approximately 2 inches. The dome has a height H2 of approximately 7⅜ inches measured from the top of the frosted dome mounting rail 306 to the top of the dome. The dimensions herein are illustrative and may vary. For example, the frosted dome mounting rail 306 may have a length L of 60 inches or other shorter or longer lengths.

Each frosted beverage chilling and dispensing dome 310A, 310B, 310C and 310D has an incoming coolant line ICL and an outgoing coolant line OCL journalled through the frosted dome mounting rail 306 and into the interior of the frosted beverage chilling and dispensing dome. In an exemplary embodiment, the coolant lines ICL and OCL enter in front of the dome 310A, 310B, 310C, and 310C in proximity to a port 658 (FIG. 6A) for the dispensing faucet 316A, 316B, 316C and 316D, respectively.

Figure 5:
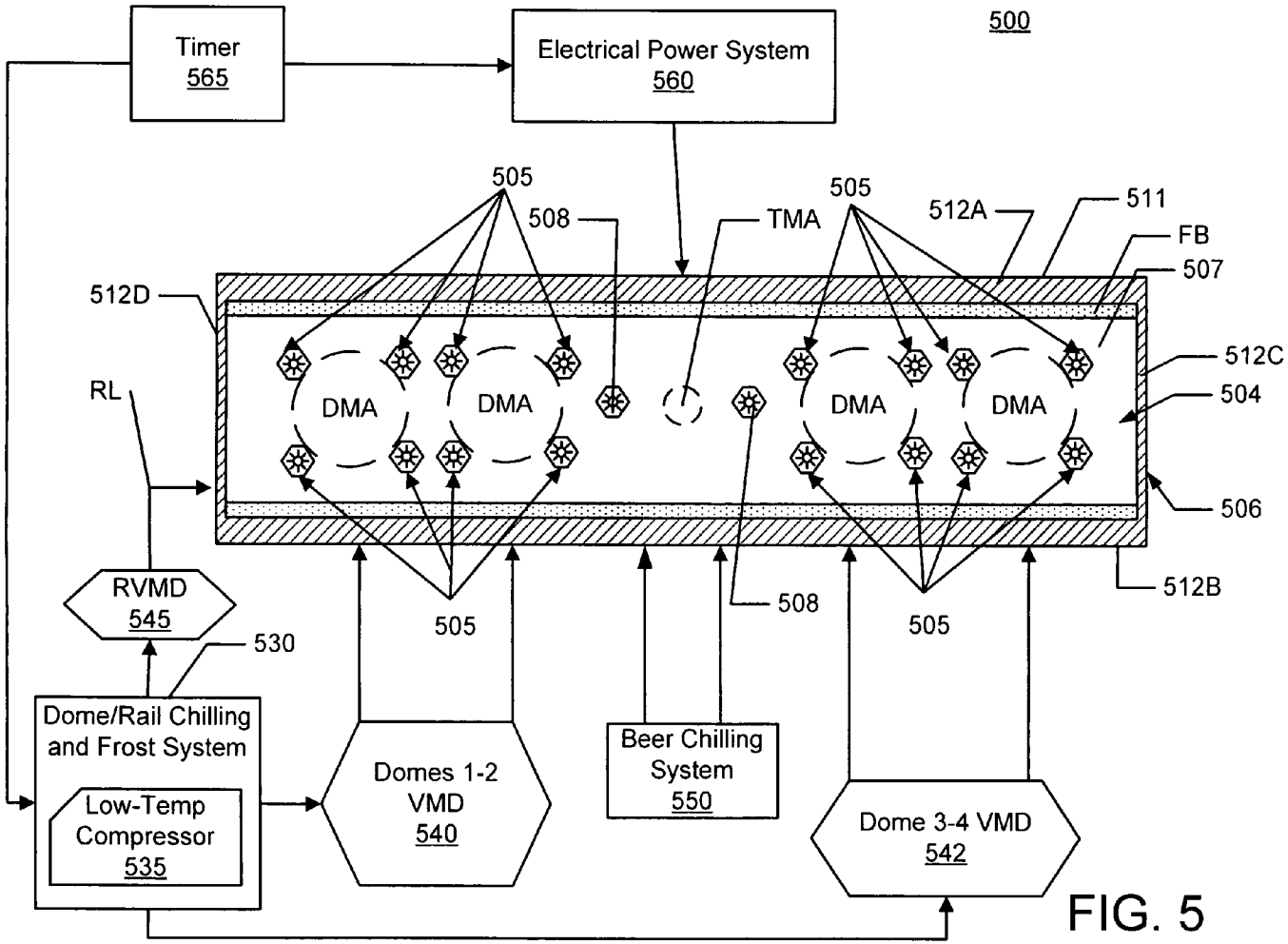
FIG. 5 illustrates a schematic view of the frosted beverage chilling and dispensing system with lights in accordance with some of the exemplary embodiments.

The frosted dome mounting rail 306 is mounted to a bar (e.g., bars 102 or 202) via studs 318A and 318B. The frosted dome mounting rail 306 receives the coolant lines ICL and OCL from a remote dome/rail chilling and frost system 530, as best seen in FIG. 5. The frosted dome mounting rail 306 includes one or more drains 330A, 330B to capture and channel water or fluid of defrosting ice away from and out of the frosted dome mounting rail 306. The frosted dome mounting rail 306 captures the water or fluid created by defrosting ice or frost on the domes via a freeze break FB (FIG. 5).

The center of the frosted dome mounting rail 306 has mounted thereto the frozen beer dispensing tower 320. However, other beverages may be dispensed from the tower 320. The frozen beer dispensing tower 320 has a tower body 326, made of metal such as stainless steel. While yellow metals may be used, stainless steel may be preferred. The stainless steel tower body 326 has a hollow interior configured to be flooded (filled) with the coolant or refrigerant in the beer lines BCL used to chill the beer or other beverage sent to the tower 320 to be dispensed. The coolant or refrigerant in the beer lines BCL is then returned to the beer chilling system 550 (FIG. 5) via return lines of the beer lines BCL.

Generally, lines carrying beer or other beverages are communicated to the dispensing tower 320 in parallel with coolant or refrigerant lines used to chill or keep chilled the beer or beverage. The coolant and refrigerant may be returned via return lines to the remote beer chilling system 550 (FIG. 5). However, the frozen beer dispensing tower 320 is flooded with the coolant and refrigerant to chill and frost the exterior surface of the tower 320. The dispensing tower 320 is configured to create frost along the perimeter surface.

Figure 3D:
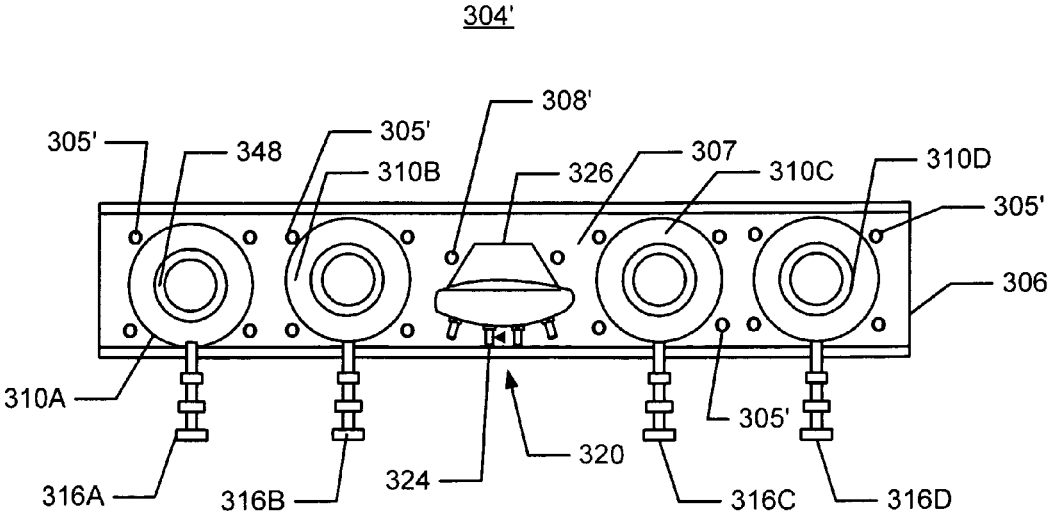
FIG. 3D illustrates a top schematic view of the frosted beverage chilling and dispensing device (with lights) in accordance with some exemplary embodiments.

FIG. 3D illustrates a top schematic view of the frosted beverage chilling and dispensing device 304' (with lights) in accordance with some exemplary embodiments. The frosted beverage chilling and dispensing device 304' is essentially the same as device 304 of FIGS. 3A-3C except that the device 304' has lights 305' and 308'. The lights 305' surround the base of each dome 310A, 310B, 310C, and 310D. The lights 308' are spaced about the base of the dispensing tower 320. Nevertheless, the lights may be arranged in different configurations.

The lights 305' and 308' may be light emitting diodes (LEDs), low voltage lights or other illuminating means that produce low heat.

The embodiments of FIGS. 1 and 2 mount the frosted beverage chilling and dispensing device 104 and 204 on top of bars 102 and 202. However, the devices 104 and 204 may be modified with the devices 304 or 304' of FIGS. 3A and 3D.

Figure 4:
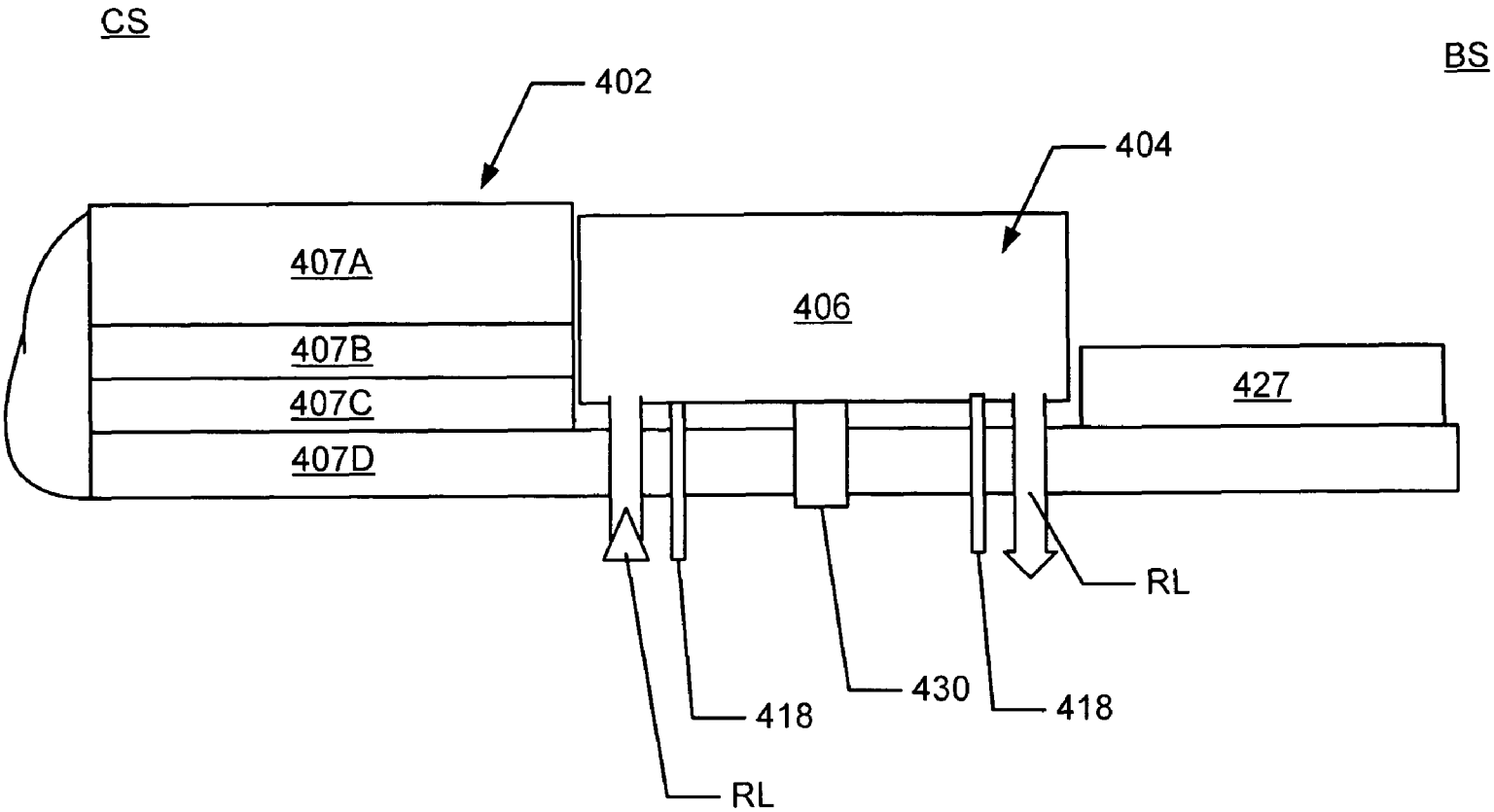
FIG. 4 illustrates a schematic diagram of a bar structure configured for installation of frosted beverage chilling and dispensing device in accordance with some exemplary embodiments.

FIG. 4 illustrates a schematic diagram of a bar structure 402 configured for installation of frosted beverage chilling and dispensing device 404 in accordance with some exemplary embodiments. The bar structure 402 can be used to install one or more frosted beverage chilling and dispensing devices 404. The devices 404 may have any of the configurations described above in relation to FIGS. 1, 2, 3A and 3D. The bar structure 402 may include a drink rail system 427 in closest proximity to the bartender side BS of the bar structure 402. The bar structure 402 further includes a customer side CS having a bar top member 407A followed by one or more layers of bar support members 407B, 407C and 407D below the bar top 407A. The layers of bar support members 407B, 407C and 407D are parallel and below the bar top 407A. The bar top 407A may be granite, wood or some other material. The customer side CS of the bar structure has a height that is higher than the drink rail system 427. The lower bar support member 407D extends from the customer side CS to the bartender side BS and supports thereon the drink rail system 427.

Between the customer side CS and the drink rail system 427, the frosted dome mounting rail 406 may be mounted therebetween via studs 418. The lower bar support member 407D has the apertures formed therein for placement of the drain 430, and coolant/refrigerant lines RL of the frosted beverage chilling and dispensing device 404.

FIG. 5 illustrates a schematic view of the frosted beverage chilling and dispensing system 500 with lights 505 and 508 in accordance with some of the exemplary embodiments. The system 500 includes a remote dome chilling and frost system 530, a remote beer chilling system 550, and electrical power system 560, all of which are coupled to one or more frosted beverage chilling and dispensing devices 504. A timer 565 is connected to the remote dome chilling and frost system 530 and the electrical power system 560 to turn off or on the one or more frosted beverage chilling and dispensing devices 504.

A remote beer chilling system 550 is described in U.S. Pat. No. 7,389,647, titled "Closed System and Method for Cooling and Remote Dispensing of Beverages at Guaranteed Temperatures" incorporated herein by reference as if set forth in full below.

The remote dome chilling and frost system 530 employs a refrigerant such as Freon to be chilled to −20° F.--30° F. The remote dome chilling and frost system 530 includes a low-temp refrigeration compressor 535 with a "refrigerant 404A" or Freon or other non-Freon type coolants. An example of a low-temp refrigeration compressor 535 may be available by Dan Foss™, of Germany. The compressor 535 is flooded or filled with a refrigerant for a closed loop system.

The electrical power system 560 may include the electrical system of the bar establishment and connected to the public utility service. However, a battery system may be used.

The one or more frosted beverage chilling and dispensing devices 504 are arranged to support the embodiments of FIG. 3D having a frozen beer dispensing tower 320. The one or more frosted beverage chilling and dispensing devices 504 includes a top rail plate 507 having a plurality of dome mounting areas, denoted by DMA. Each dome mounting area DMA has an area defined by the dashed lines. The domes 310A, 310B, 310C and 310D (FIG. 3D) are mounted to a respective one dome mounting area DMA. Each dome mounting area DMA is surrounded by a plurality of lights 505 mounted in the frosted dome mounting rail 506. The lights 505 may include an illuminating means, light emitting diodes (LEDs) or low voltage lighting positioned about each of the dome mounting areas DMA. In the exemplary embodiment, the frosted dome mounting rail 506 further includes lights 508 which may be an illuminating means, light emitting diodes (LEDs) or low voltage lighting positioned about the frosted beer dispensing tower 320 (FIG. 3D).

Each dome mounting area DMA has four lights 505 to illuminate around a base of the dome. Nonetheless, instead of positioning the lights 505 around the dome base or dome mounting area DMA, the lights 505 may be arranged in a row along the frosted dome mounting rail 506. In an embodiment, the lights 505 are equally spaced from adjacent lights around the dome base or dome mounting area DMA.

In the embodiment of FIG. 5, only one frosted beverage chilling and dispensing device is shown. The frosted beverage chilling and dispensing device 504 includes a frosted dome mounting rail 506 configured to support a plurality of frosted beverage chilling and dispensing domes 310A, 310B, 310C and 310D (FIG. 3D) configured to chill and dispense beverages within the dome. The domes are configured to create snowy white frosted ice or frost around evenly about its perimeter. The frosted beverage chilling and dispensing device 504 further includes a tower mounting area TMA to mount a frosted beer dispensing tower 320 thereto.

In an embodiment, frost forms down the dome exterior wall and onto the frosted dome mounting rail 506. Over time, the frost may appear continuous such that a separation between the frost on the dome and the frost on the frosted dome mounting rail 506 appear as continuous with no breaks or separation lines.

In the exemplary embodiment, the coolant lines are coupled to valve-metering devices (VMD) 540 and 542 to deliver a metered amount of coolant to domes. The VMD 540 is associated with domes 1 and 2. The VMD 542 is associated with domes 3 and 4. The amount of coolant is based on the distance or length of the line within the dome and to the dome. The amount of coolant through the rail VMD 545 to the frosted dome mounting rail 506 is a function of the length of coolant lines along the frosted dome mounting rail 506 and to the frosted dome mounting rail 506 to achieve the frost.

In the exemplary embodiment, the VMD 540 and 542 support two separate coolant lines (in and out) to each dome. However, if the device 504 has five domes, one of the valve-metering devices could be designed to support three domes to deliver a set amount of coolant to each dome.

The frosted dome mounting rail 506 includes a base pan 511 made of metal, natural material, man-made material or a combination of natural and man-made materials. The base pan 511 includes side walls 512A and 512B and end walls 512C and 512D. The end walls 512C and 512D may be separate end plates or caps configured to be attached, sealed, affixed or integrated to the base pan 511.

The frosted dome mounting rail 506 further comprises a top rail plate 507 made of metal (e.g. stainless steel) having supports flanges or legs (FIGS. 8A-8C) to rest or support the top rail plate 507 within the base pan 511. Frost or snowy white frosted ice is created on a top rail plate 507.

FIG. 6A illustrates a perspective view of a frosted beverage chilling and dispensing dome 610 in accordance with some of the exemplary embodiments. The dome 610 comprises, in general, a cylindrical shaped structure 640 with a curved exterior perimeter surface 641. In lieu of a curve exterior perimeter 641 or cylindrically shaped dome, a square shape, rectangular shape, truncated-triangular shape, truncated-pyramid shape, truncated-cone shaped, spherical shape or other geometric shapes may be used.

The frosted beverage chilling and dispensing dome 610 further includes an interior cavity 645 (represented by the dashed lines) with a closed bottom end 646A and a top opening 646B. The interior cavity 645 serves as an internal storage and chilling tank. The frosted beverage chilling and dispensing dome 610 includes an access port 658 formed through the curved exterior perimeter surface 641 and the interior cavity 645. A dispensing faucet 316A-316D such as shown in FIGS. 3A-3B would be coupled thereto.

The bottom end 642 of the curved exterior perimeter surface 641 has coupled thereto securing tabs 650 to couple the bottom end 642 or dome base of the dome 610 to the frosted dome mounting rail 506 (FIG. 5). The dome 610 is configured to be mounted to a dome mounting area DMA (FIG. 5). The top rail plate 507 includes slots to match the pattern of securing tabs 650. The slot receives the securing tab 650. In an embodiment, the securing tab 650 is configured to be crimped or bent under the top rail plate 507 so that the dome 610 cannot be lifted or moved.

The top center of the dome 610 has a top opening formed therein which corresponds with the top opening 646B of the interior cavity 645. The top opening 646B, in the exemplary embodiment, has a bottle seat 648 coupled thereto. The bottle seat 648 is made of plastic or other natural or man-made materials. The bottle seat 648 cradles and supports a vertically upside-down liquor bottle. In an embodiment, a liner 649 surrounds the bottle seat 648 which is made of Acetal or other hard plastic for the temperature range described herein. Acetal is white in color and can serve as a freeze break so that frost does not grow up the bottle seated in the bottle seat 648.

While not wishing to be bound by theory, frost on the top of the dome 610 is formed in part by the growth of the frost from the sides of the dome 610. The frost will generally stop at the liner 649 or freeze break. The liner 649 provides a freeze break. The liner 649 does not generally form frost thereon and is made of a non-metallic material which would not promote frost development or growth.

Figure 7A:
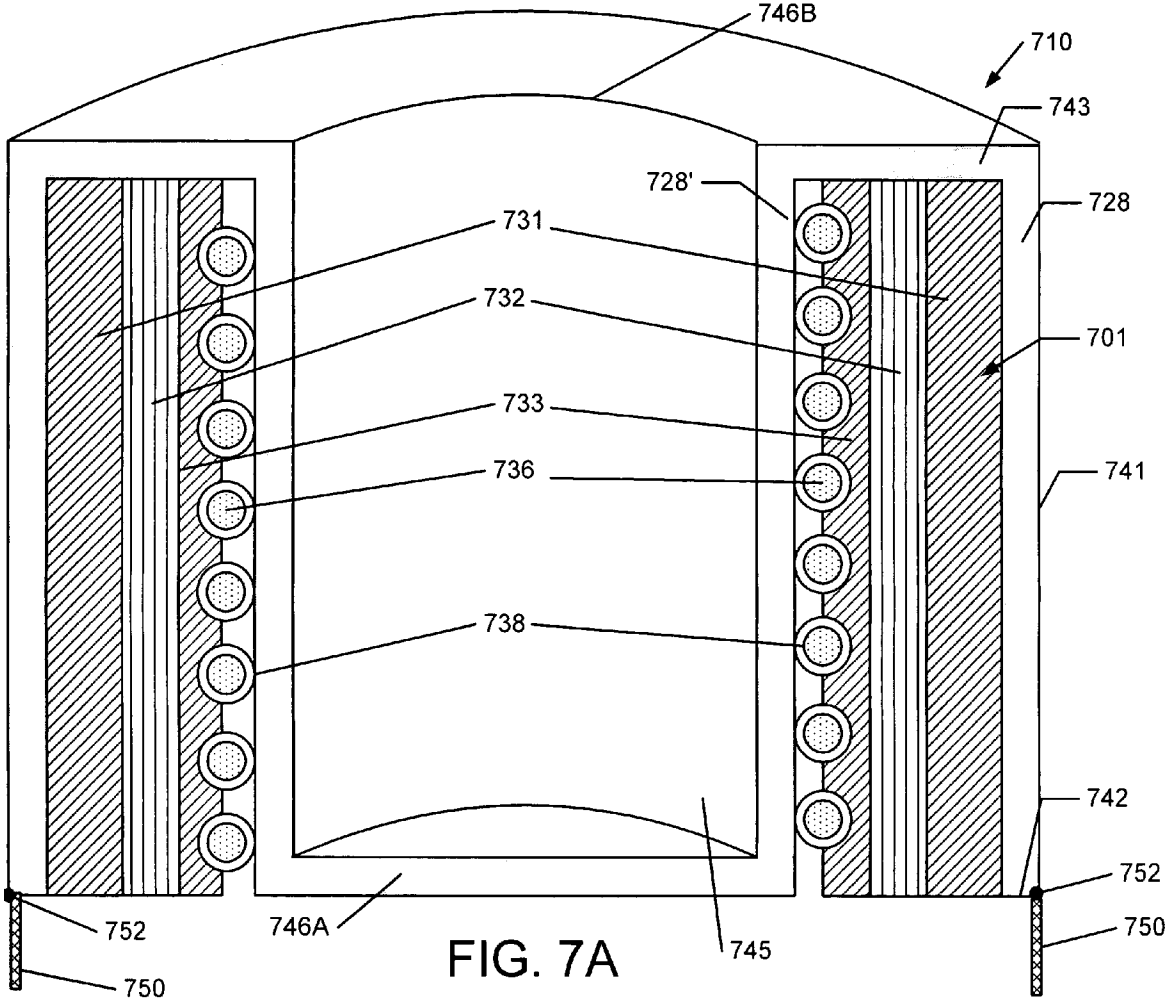
FIG. 7A illustrates a cross sectional view of a frosted beverage chilling and dispensing dome in accordance with some of the exemplary embodiments.

In an embodiment, frost generally does not form under the liner 649 or within the dome's interior. Thus, frost does not form in the interior or interior cavity 645 of the dome 610. The interior cavity 645 is an interior liner within the dome, as best seen in FIG. 7A.

FIG. 6B illustrates a perspective view of an frosted beverage chilling and dispensing dome 610 with a seated liquor bottle B in accordance with some of the exemplary embodiments. The liquor bottle B is turned upside down so that the open end of the bottle B can be received within the dome 610 and in the interior cavity 645. The liquor beverage LIQ pours out of the liquor bottle B automatically under the force of gravity. The liquor beverage LIQ from the bottle B is stored in the interior cavity 645. The interior cavity 645 is made of a metal material that is configured to be chilled. The liquor beverage LIQ when in contact with the interior cavity 645 (metal liner) causes the liquor beverage LIQ to chill.

The viscosity of one or more of the liquor beverages LIQ when stored in the dome's interior cavity 645 may change. The liquor beverage LIQ may be thicker than the traditional free flowing liquor beverage at room temperature. The liquor beverage LIQ may not freeze depending on the alcoholic content. Moreover, the viscosity can change.

In the exemplary embodiment, the viscosity may change to be thicker without a frozen slush being formed.

Figure 8A:
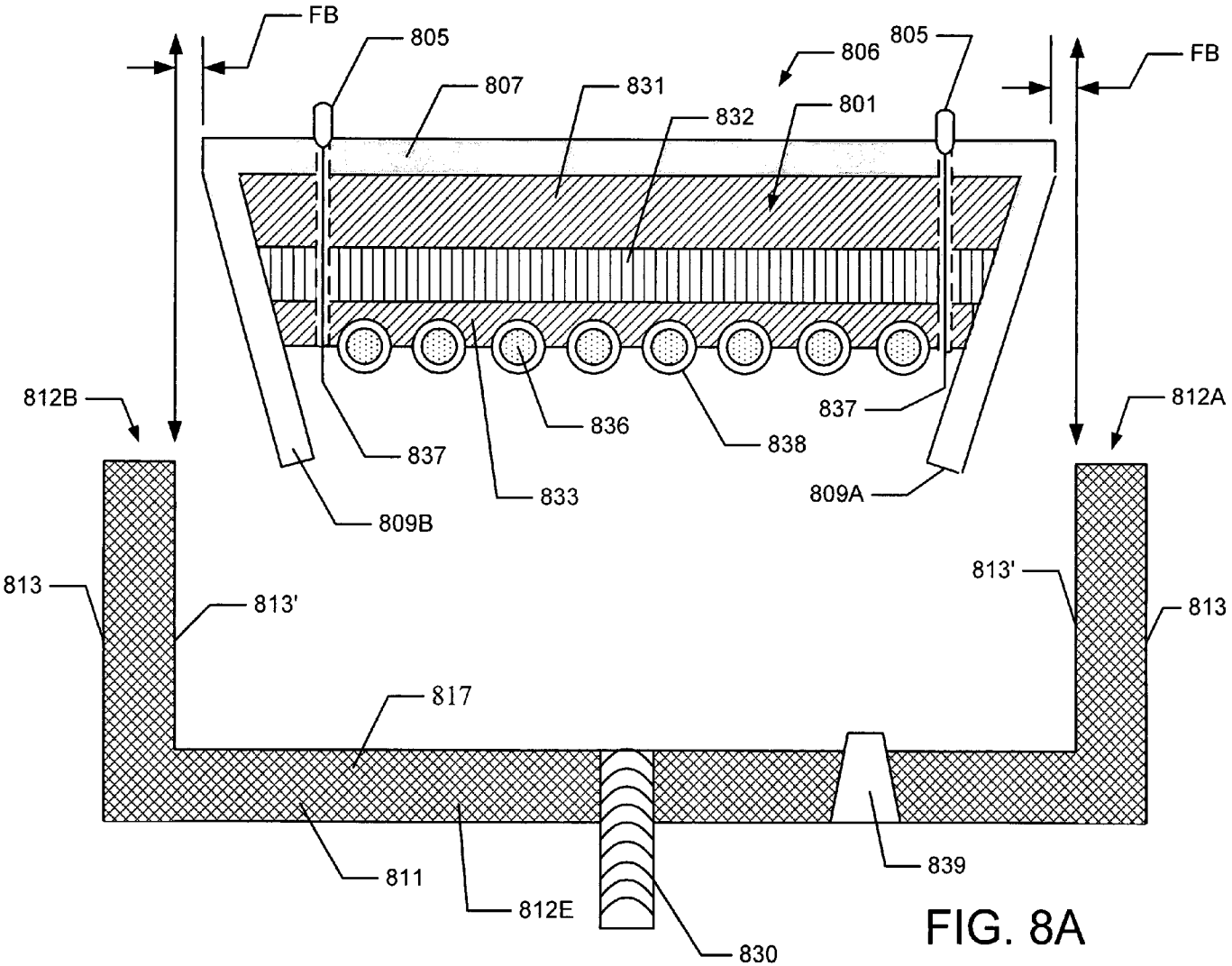
FIG. 8A illustrates a cross sectional view of a frosted dome mounting rail with a portion raised from the base pan in accordance with some of the exemplary embodiments.
Figure 8B:
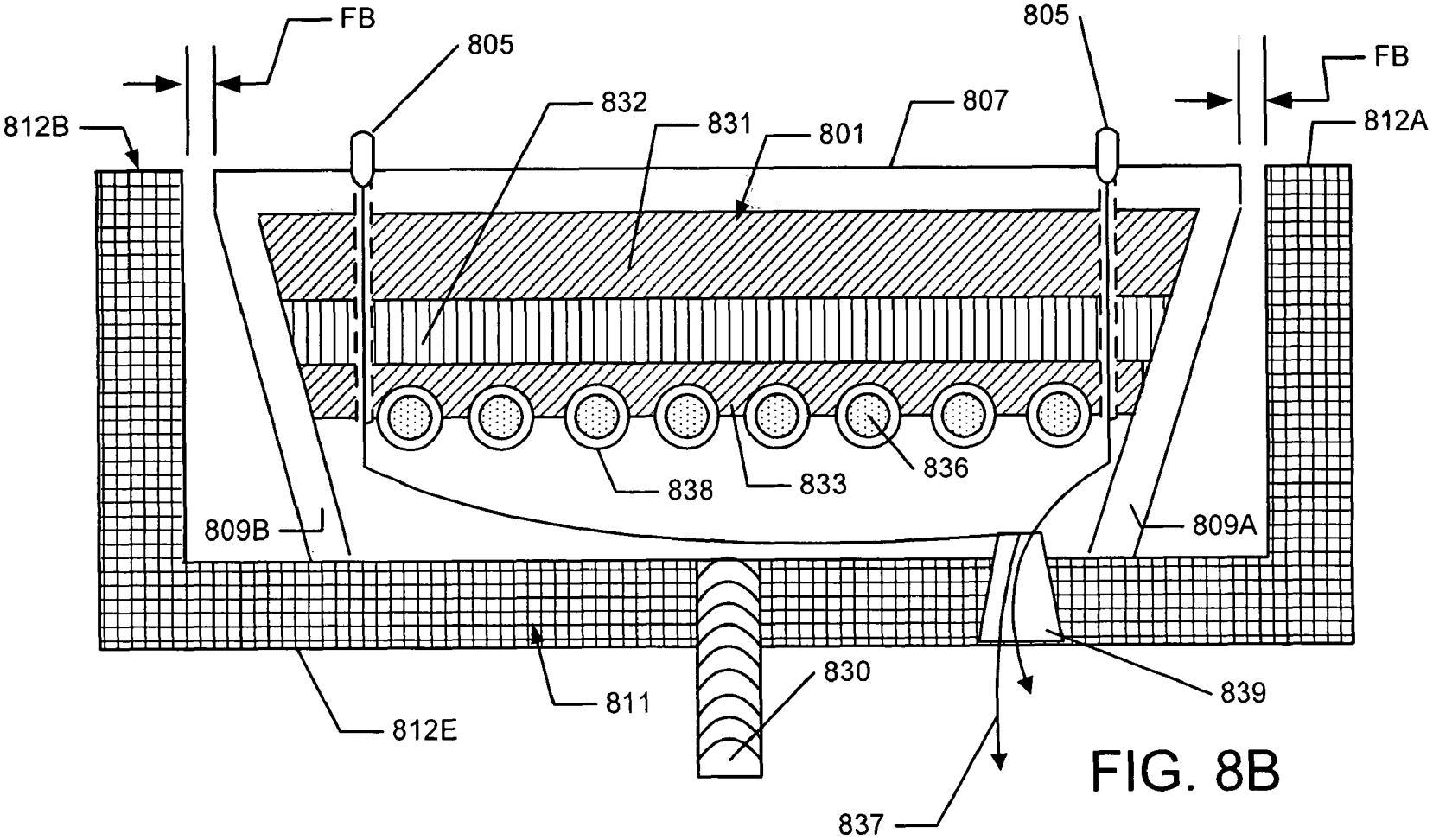
FIG. 8B illustrates cross sectional view of a frosted dome mounting rail in accordance with some of the exemplary embodiments.
Figure 8C:
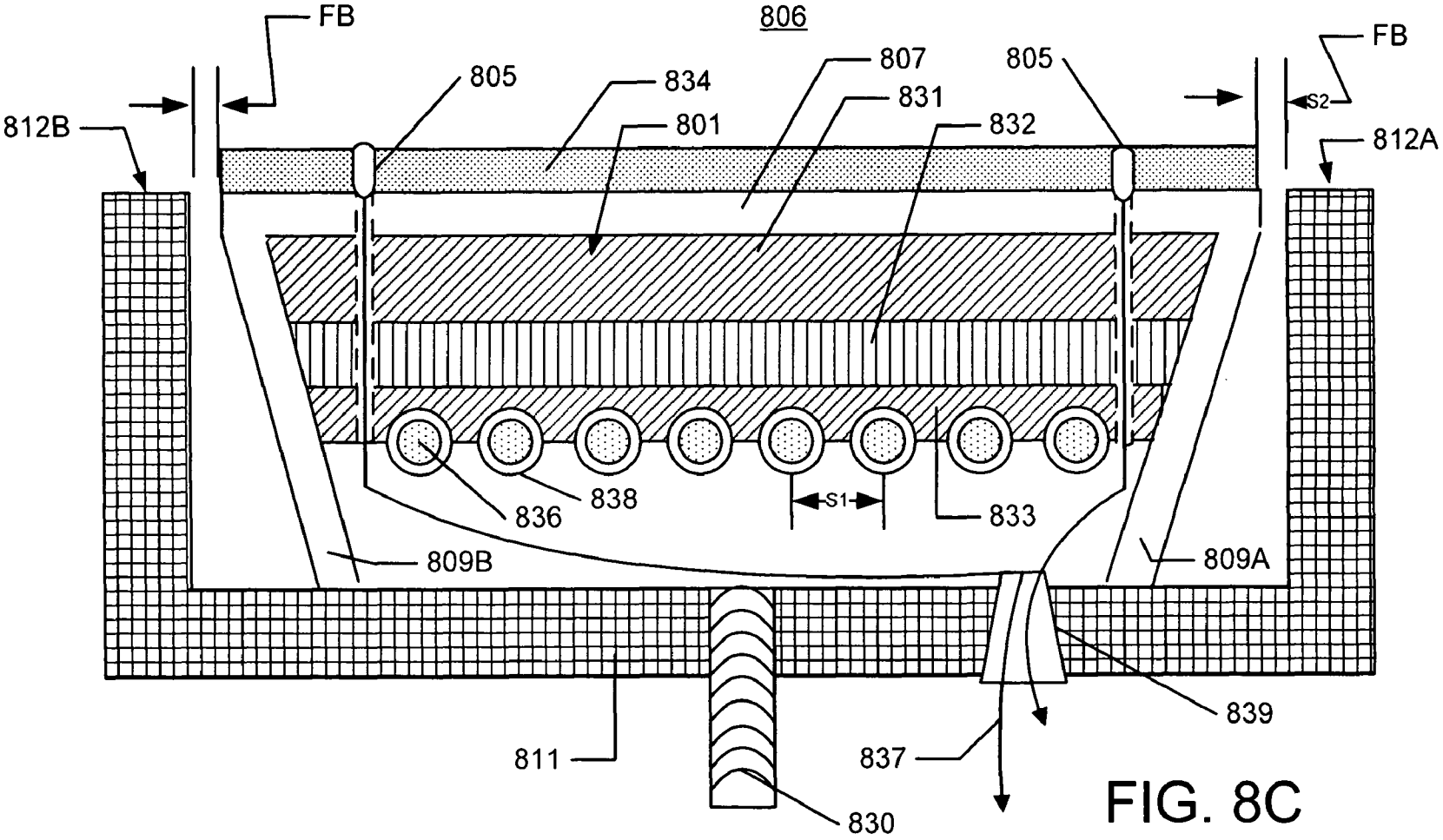
FIG. 8C illustrates cross sectional view of a frosted dome mounting rail (with ice) in accordance with some of the exemplary embodiments.

FIGS. 8A-8C illustrate a cross sectional of the frosted dome mounting rail 806. FIG. 8A is shown with the rail top plate 807 raised above the base pan 811. FIG. 8C shows a layer of frost or ice 834. The frosted dome mounting rail 806 includes a base pan 811. The base pan 811 includes a double insulated wall structure defining a pan or drip pan. The pan 811 includes two side walls 812A and 812B and a floor 812E with a drain 830. The floor 812E also includes a grommet 839 through which electrical wires are fed. The grommet 839 may be rubber or other sealable material that prevents water from flowing through. The two side walls 812A and 812B and base pan 811 form a double insulated wall structure. The double insulated wall structure includes two parallel walls 813 and 813' having insulation 817 therebetween. The insulation 817 may include high density Urethane. The wall 813 has a generally U-shape defining wall 812A, floor 812E and wall 812B. Wall 813' has a generally U-shaped defining wall 812A, floor 812E and wall 812B. The wall 813 and 813' are separated by the insulation 817.

The base pan 811 may be made of metal, natural material, man-made material or a combination of natural and man-made materials. The walls 813 and 813' of the base pan 811, of the exemplary embodiment, may be made of stainless steel or other metals or materials.

The base pan 811 includes two side walls 812A and 812B and two end walls or separate end plates or caps 512C and 512D (FIG. 5) configured to be attached, sealed, affixed or integrated to the base pan 811.

The frosted dome mounting rail 806 further comprises a top rail plate 807 made of metal (e.g. stainless steel) having supports flanges or legs 809A and 809B to rest or support the top rail plate 807 within the base pan 811. A layer of frost or snowy white frosted ice 834 is created on a top rail plate 807 made of metal (e.g. stainless steel).

An objective of the present invention is to create a self wicking frost building rail (e.g., rail 806) that can be placed in any room at room temperature or other temperatures. The air conditioning and heating system may be on so as to cool or heat the ambient air. The ambient air can have a wide range of temperatures (68° F. to 78° F.). Most establishments may want to keep their patrons comfortable as the weather changes. Frost is created in most all room temperatures and may not require any special room temperature. However, humidity should be greater than 0%. In an embodiment, humidity should be greater than 20%. The more the humidity in the ambient air, the quicker the frost may form.

The layer of frost or snowy white frosted ice 834 is created by the freezing and chilling mechanism 801 having refrigerant or coolant 836 in refrigerant lines 838 embedded under the top rail plate 807. The refrigerant lines 838 may carry Freon or other refrigerant that can be chilled to −20° F. to −30° F. The refrigerant lines 838 are separated by a predetermine distance S1 (FIG. 8C). In one example, the distance S1 is 1¼ inches on center. The refrigerant lines 838 may have an OD of ⅜ inches may be coiled or arranged in a serpentine arrangement. The refrigerant lines 838 may have other ODs and the spacing distance S1 may vary. However, the spacing between refrigerant lines 838 should be such that a continuous sheet of frost or snowy white frosted ice 834 is created uniformly on top of the top rail plate 807. The freeze break FB is approximately 1/16-⅛ of an inch.

While not wishing to be bound by theory, the continuous and uniform sheet or layer of frost or ice 834 is created by continuous and uniform layers of thermally conductive materials which may be metallic and non-metallic with high thermal conductivity factors. A top layer 831, immediately below the top rail plate 807, includes a thermal compound. In an embodiment, the thermal compound of the top layer 831 is non-metallic but is highly conductive of temperature and especially cold temperatures. Thus, top layer 831 is a first non-metallic thermal layer.

The thermal compound is followed by a metal thermal conductor layer 832 such as a sheet of metal with a high thermal conductivity. The metal thermal conductor layer 832 may include metals with a thermal conductivity factor greater than 90 or 100, such as without limitations aluminum, silver, gold, copper, etc. The top rail plate 807 is made of a metal which has a thermal conductivity factor which is less than 90 or 100.

Below the metal thermal conductor layer 832 there is another thermal compound layer (hereinafter referred to as "the second non-metallic thermal layer 833") with the refrigerant lines 838 partially or fully embedded therein. The layers of metallic and non-metallic layers (e.g., layers 831, 832 and 833) channel the cold temperatures in the refrigerant lines 838 upward to the top rail plate 807 where self-wicking of moisture takes place by drawing in and freezing the moisture or water in the ambient air (humidity). The freezing and chilling mechanism 801 includes the layers of metallic and non-metallic layers (e.g., layers 831, 832 and 833).

The lights 805 are LEDs or low voltage lights installed or embedded in the top rail plate 807 and layers 831, 832 and 833. The electrical wires 837 to the lights 805 are fed to the grommet 839. The lights 805 create little heat. However, the heat limits or minimizes the frost from completely covering the lights 805.

It should be noted that leaving the system 100, 200, or 500 on will increase the depth of the layer of frost or snowy white frost or ice 834 on the domes and rail, as frost will keep building. Therefore, to control the height of the frost or snowy white frost or ice 834, the system 100, 200, or 500 needs to be turned off at periodic intervals such as at the end of the business day/night. Additionally, the amount of humidity may increase the height of the frost generated. The more humidity the thicker (taller) the layer of frost or snowy white frost or ice 834.

Figure 7B:
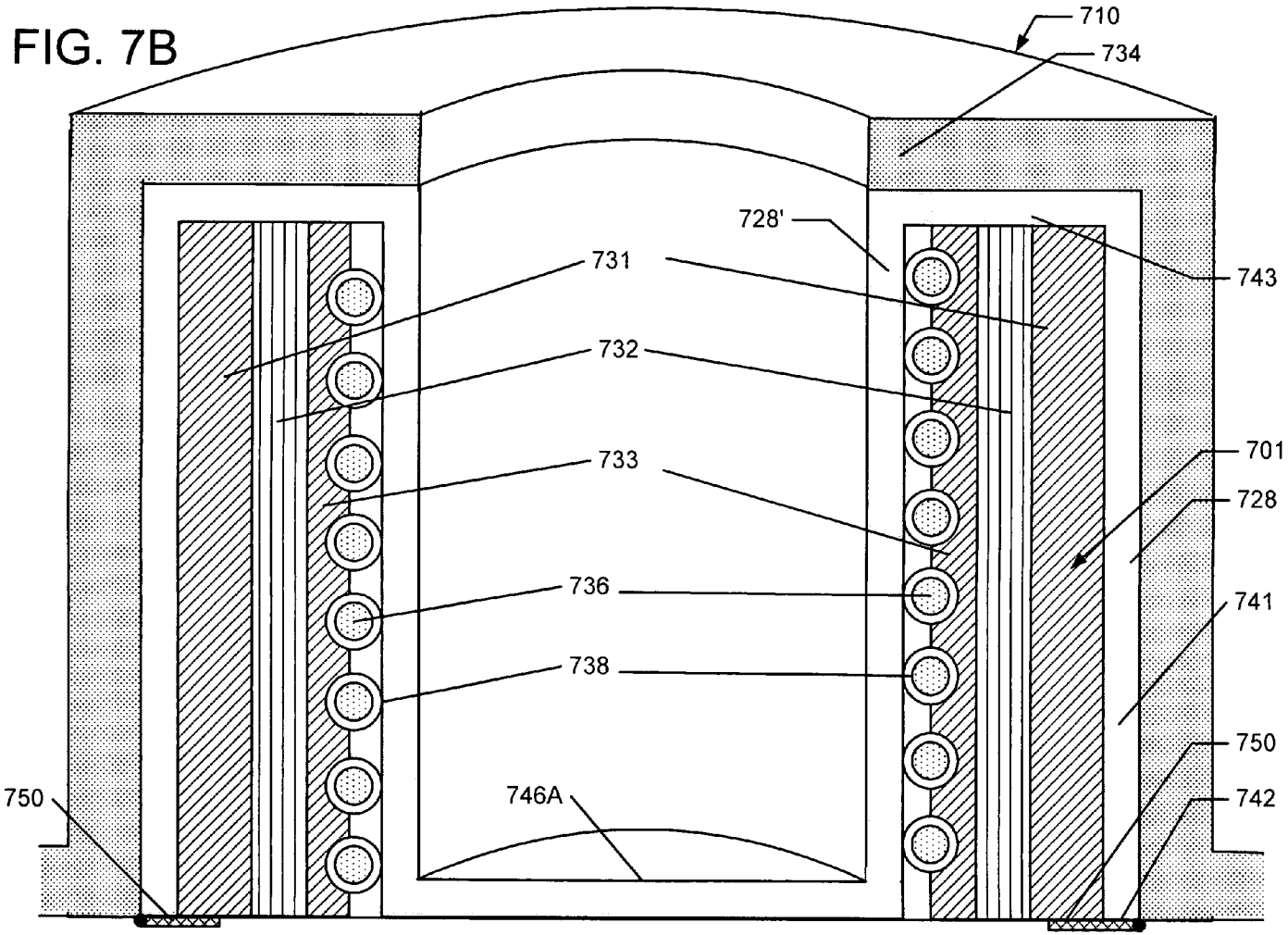
FIG. 7B illustrates a cross sectional view of a frosted beverage chilling and dispensing dome with frosted ice in accordance with some of the exemplary embodiments.

FIG. 7A illustrates a cross sectional view of a frosted beverage chilling and dispensing dome 710 in accordance with some of the exemplary embodiments. FIG. 7B illustrates a cross sectional view of an frosted beverage chilling and dispensing dome 710 with a layer of frosted ice 734 in accordance with some of the exemplary embodiments. The liner 649 (FIG. 6A) for the seat is not shown in FIGS. 7A-7B.

The layer of frosted ice 734 is created by the dome 710 in a similar manner as the rail 806 (FIGS. 8A-8C) previously described. The dome 710 includes two concentric walls 728 and 728' to form the exterior wall 741 and the interior wall 745. The interior wall 745 serves as the interior cavity 645 (FIG. 6). The exterior wall 741 and the interior wall 745 are joined together with a top wall 743. The exterior wall 741, interior wall 745 and top wall 743 form a U-shaped. The gap between the exterior wall 741 and the interior wall 745 forms a gap under the top wall 743.

Within this gap the freezing and chilling mechanism 701 is placed. The freezing and chilling mechanism 701 includes (adjacent to the exterior wall 741 made of metallic material) a first non-metallic thermal layer 731 of a thermal compound which is concentric to the exterior wall 741 or dome rail plate. In an embodiment, the thermal compound is non-metallic but is highly conductive of temperature and especially cold temperatures. The thermal compound is followed by a metal thermal conductor layer 732 (such as a sheet of metal with a high thermal conductivity) concentric with the exterior wall 741. The metal thermal conductor layer 732 may include metals with a thermal conductivity factor greater than 90 or 100, such as without limitations aluminum, silver, gold, copper, etc. The dome rail plate (exterior wall 741) is made of a metal which has a thermal conductivity factor which is less than 90 or 100.

Adjacent the metal thermal conductor layer 732 there is another layer of a thermal compound (hereinafter referred to as "the second non-metallic thermal layer 733") with the refrigerant lines 738 partially or fully embedded therein. The concentric layers of metallic and non-metallic layers (e.g., layers 731, 732 and 733) channel the cold temperatures in the refrigerant lines 738 sideways or horizontally to the exterior wall 741 (dome rail plate) where self-wicking of moisture takes place by drawing in and freezing the moisture or water in the ambient air (humidity).

The refrigerant lines 738 with refrigerant or coolant 736 also chill the interior wall 745 (inner most dome wall) without frost build up. The refrigerant lines 738 with refrigerant or coolant 736 create in combination with the freezing and chilling mechanism 701 the layer of frost or ice. The interior wall 745 becomes very cold to chill the liquor beverage to be stored therein. The interior of the dome is sufficiently sealed or closed off from humidity of the ambient air to prevent the formation of frost in the interior. The freeze break (NOT SHOWN) stops the frost from building as per the seat plastic. The interior cavity or interior wall 745 includes a bottom end 746A and a top end 746B. The top end 746B coincides with the opening into the dome 710 or interior cavity.

The bottom end 742 of the exterior wall 741 has coupled thereto securing tabs 750 to couple the bottom end 742 or dome base of the dome 710 to the frosted dome mounting rail 506 (FIG. 5). The dome 710 is configured to be mounted to a dome mounting area DMA (FIG. 5). The top rail plate 507 includes slots to match the pattern of securing tabs 750. The slot receives the securing tab 750. In an embodiment, the securing tab 750 is configured to be crimped or bent under the top rail plate 507 so that the dome 710 cannot be lifted or moved. The securing tab 750 is secured to the exterior wall 741 via a spot weld 752. However, the securing tab 750 may be integrated with the exterior wall 741 without the need for welding.

Figure 9:
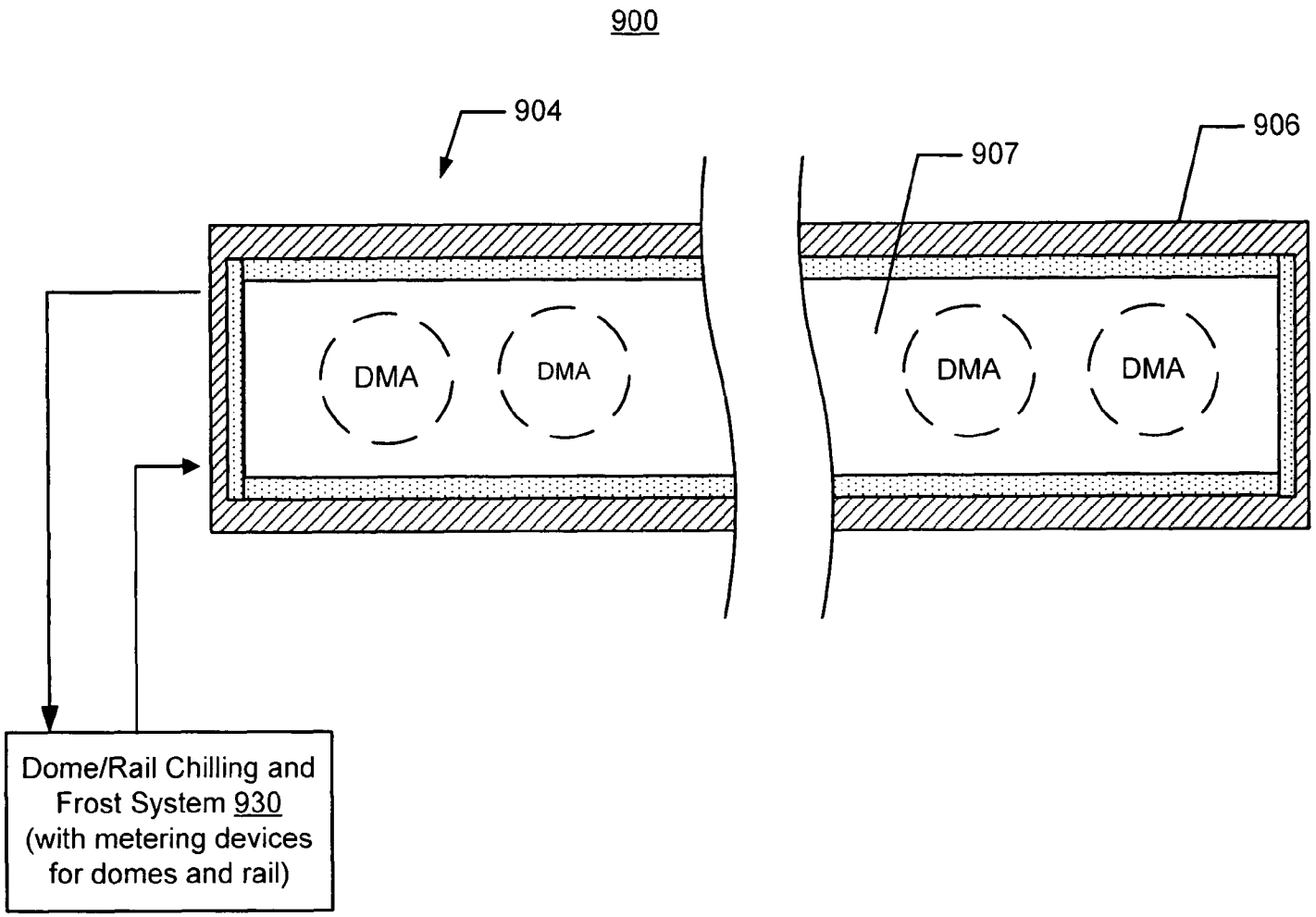
FIG. 9 illustrates a schematic view of yet another frosted beverage chilling and dispensing system in accordance with some of the exemplary embodiments.

FIG. 9 illustrates a schematic view of yet another frosted beverage chilling and dispensing system 900 in accordance with some of the exemplary embodiments. The system 900 includes one or more frosted beverage chilling and dispensing devices 904. Each device 904 includes a frosted dome mounting rail 906 with one or more frosted beverage chilling and dispensing domes (NOT SHOWN) configured to chill beverages within the dome. Each frosted beverage chilling and dispensing dome is coupled to a dome mounting area DMA. The domes are configured to create snowy white frosted ice or frost evenly about its perimeter. Likewise, the frosted dome mounting rail 906 is configured to create snowy white frosted ice or frost evenly along its length.

In the system 900 of FIG. 9, the electrical system to the rail 906 has been omitted. Furthermore, the rail 906 only accommodates domes and does not provide a mount for a beer dispensing tower. The system 900 further includes a dome/rail chilling and frost system 930 with metering devices for domes and rail.

Figure 10A:
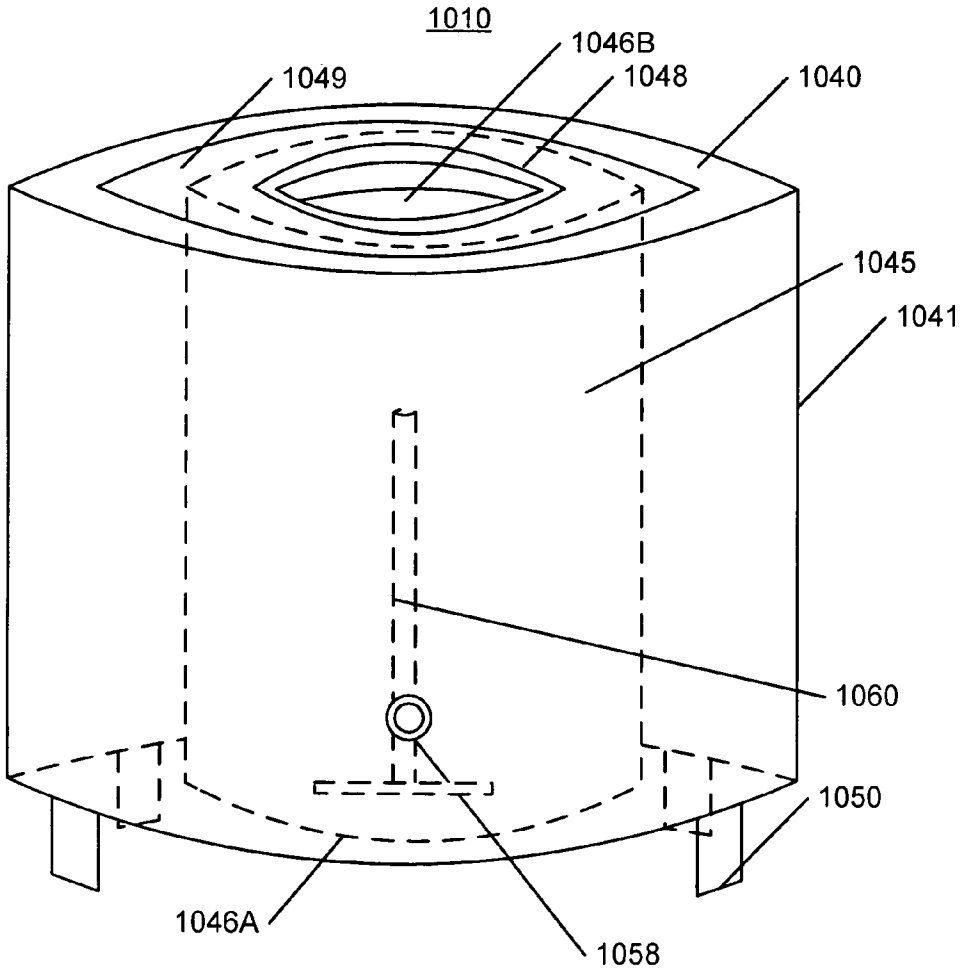
FIG. 10A illustrates a view of the interior of the dome with a bottle stabilizing bar in accordance with some of the exemplary embodiments.
Figure 10B:
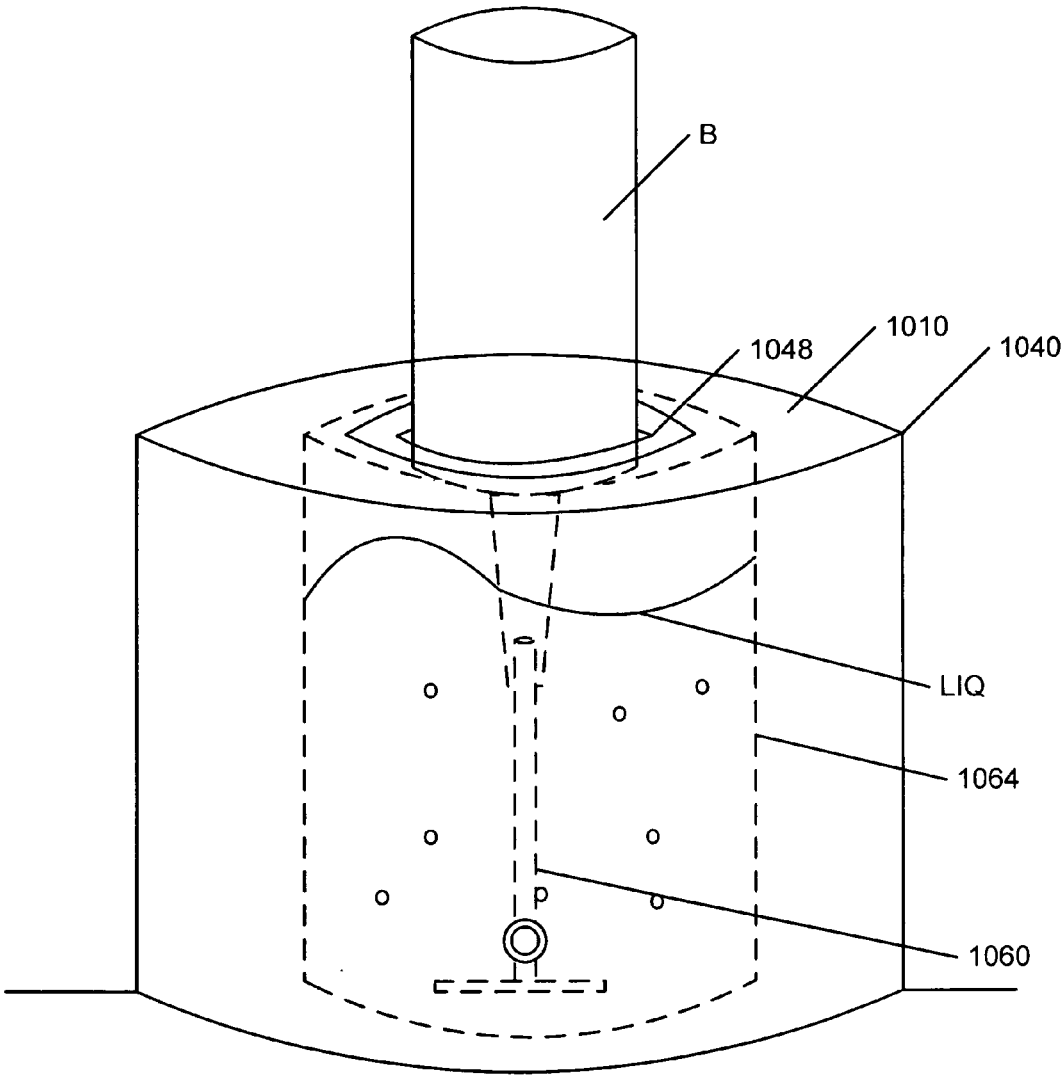
FIG. 10B illustrates a view of the interior of the dome with a bottle stabilizing bar stabilizing a bottle in accordance with some of the exemplary embodiments.

FIG. 10A illustrates a view of the interior of the dome 1010 with a bottle stabilizing bar 1060 in accordance with some of the exemplary embodiments. FIG. 10B illustrates a view of the interior of the dome 1010 with a bottle stabilizing bar 1060 stabilizing a bottle B in accordance with some of the exemplary embodiments. The dome 1010 comprises, in general, a cylindrical shaped structure 1040 with a curved exterior perimeter surface 1041. In lieu of a curve exterior perimeter 1041 or cylindrically shaped dome, a square shape, rectangular shape, truncated-triangular shape, truncated-pyramid shape, truncated-cone shaped, spherical shape or other geometric shapes may be used.

The frosted beverage chilling and dispensing dome 1010 further includes an interior cavity 1045 (represented by the dashed lines) with a closed bottom end 1046A and a top opening 1046B. The interior cavity 1045 serves as an internal storage and chilling tank. The frosted beverage chilling and dispensing dome 1010 includes an access port 1058 formed through the curved exterior perimeter surface 1041 and the interior cavity 1045. A dispensing faucet 316A-316D such as shown in FIG. 3A-3B would be coupled thereto.

The bottom end of the curved exterior perimeter surface 1041 has coupled thereto securing tabs 1050 to couple the bottom end or dome base of the dome 1010 to the frosted dome mounting rail 506 (FIG. 5). The dome 1010 is configured to be mounted to a dome mounting area DMA (FIG. 5).

The top center of the dome 1010 has a top opening formed therein which corresponds with the top opening 1046B of the interior cavity 1045. The top opening in an embodiment has a bottle seat 1048 coupled thereto. The bottle seat 1048 is made of plastic or other natural or man-made materials. The bottle seat 1048 cradles and supports a vertically upside-down liquor bottle. In an embodiment, a liner 1049 surrounds the bottle seat 1048 which is made of Acetal or other hard plastic for the temperature range described herein. Acetal is white in color and can serve as a freeze break so that frost does not grow up the bottle seated in the bottle seat 1048.

The liquor bottle B is turned upside down so that the open end of the bottle B can be received within the dome 1010 and in the interior cavity 1045. The liquor beverage LIQ pours out of the liquor bottle B automatically under the force of gravity. The liquor beverage LIQ from the bottle B is stored in the interior cavity 1045. The operation of the dome 1010 is the same as domes 610 and 710 previously described. Thus, no further description is necessary.

The bottle B, when seated in the vertically inverted position may possibly be tipped over as workers move and work. Thus, in an effort to prevent accidental toppling of the bottle B from the dome seat 1048, a stabilizing bar 1060 is positioned within the dome's interior cavity 1045. The stabilizing bar 1060 is a thin rod capable of being journalled within the bottle B without blocking the flow of liquor out of the bottle B. The stabilizing bar 1060 and dome liner (interior cavity 1045) should be made of material that is rated as food grade. The stabilizing bar 1060 may be made of Acetal. As can be appreciated other stabilizing mechanisms to prevent the bottle from toppling out of the seat may be used. The stabilizing bar 1060 is secured in the dome's interior cavity 1045.

Figure 11:
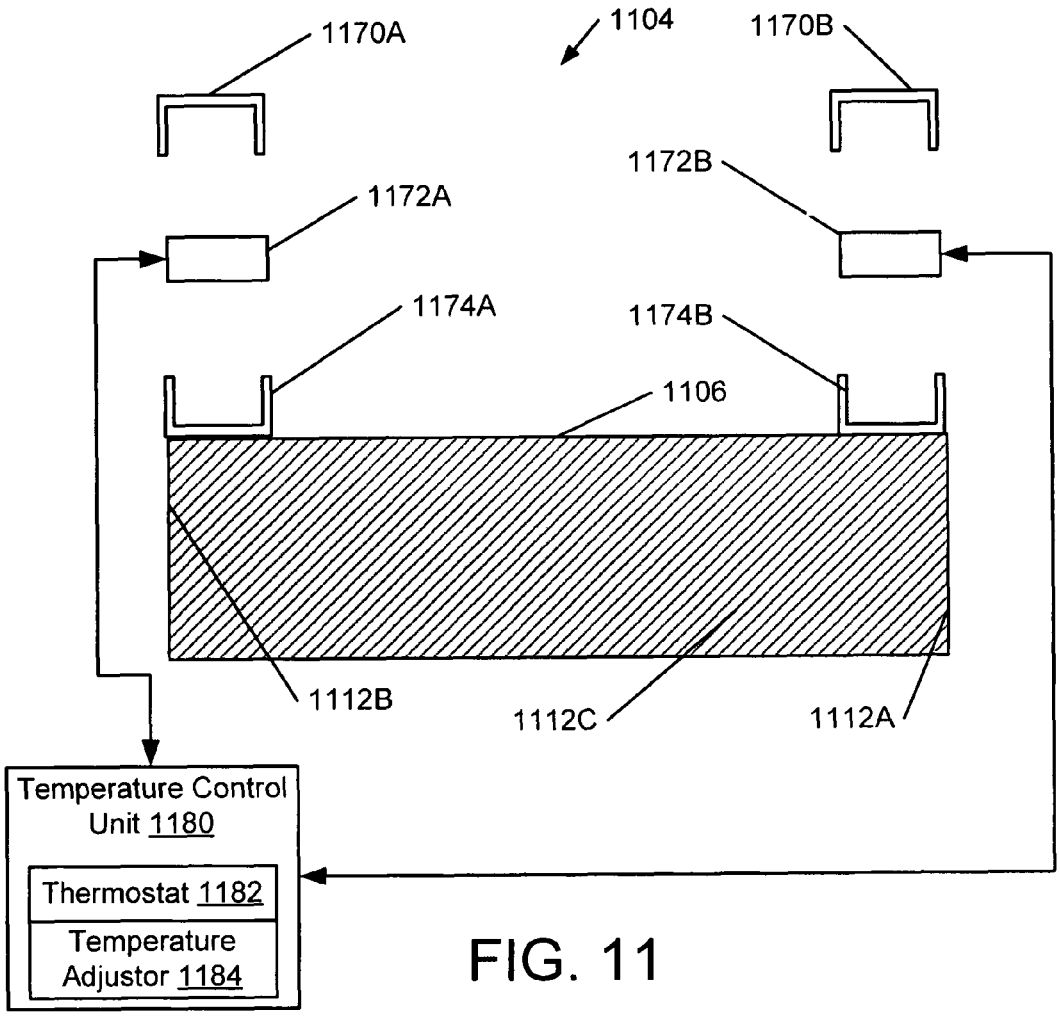
FIG. 11 illustrates an end view of yet another frosted beverage chilling and dispensing devices in accordance with some exemplary embodiments of the present invention.

FIG. 11 illustrates an end view of yet another frosted beverage chilling and dispensing device in accordance with some exemplary embodiments of the present invention. The frosted beverage chilling and dispensing device 1104 is similar to the devices 504 and 804 with the exception that heater wires are embedded in the side walls. The frosted beverage chilling and dispensing device 1104 includes a frosted dome mounting rail 1106 having a top rail plate 1107 and base pan 1111. The base pan 1111 includes two end plates (only 1112C shown), side walls 1112A and 1112B.

In the embodiment of FIG. 11, the elongated heating wires 1172A and 1172B, respectively, are within a closed channel at the top of side walls 1112A and 1112B. The closed channel for the elongated heating wire 1172A is defined by the closure of U-shaped channels 1170A and 1174A. The closed channel for the elongated heating wire 1172B defined by the closure of U-shaped channels 1170B and 1174B. The channels 1174A and 1174B are at the top of side walls 1112A and 1112B.

A temperature control unit 1180 is provided to control the heat along each of the elongated heating wires 1172A and 1172B within the closed channels. The temperature control unit 1180 includes a thermostat 1182 and a temperature adjustor 1184. The thermostat monitors the temperature along each of the elongated heating wires 1172A and 1172B. The temperature adjustor 1184 allows the temperature to be controlled or adjusted to a particular threshold. The heat/temperature from the elongated heating wires 1172A and 1172B is set to eliminate condensation. The heat caused the evaporation of water to take place during operation to eliminate condensation during operation of the frosted beverage chilling and dispensing device 1104. The heat also prevents ice from jumping off of the device 1104 and forming elsewhere.

While the invention has been particularly shown and described with references to a preferred embodiment thereof, it will be understood by those skilled in the art that various changes in form and details may be made therein without departing from the spirit and scope of the invention.

What is claimed is:

1. A device for chilling and dispensing a beverage from a bottle comprising: a mounting rail configured to attach to a bar top structure and having a top rail plate and a rail freezing and chilling mechanism under the top rail plate; and a dome configured to attach to the top rail plate and having a dome plate, interior storage tank and a dome freezing and chilling mechanism between the dome plate and the interior storage tank, the rail freezing and chilling mechanism and the dome freezing and chilling mechanism being configured to build a layer of frost on top of the top rail plate and along the dome plate from humidity of ambient air and the dome being configured to seat the bottle in an inverted position and chill and dispense the beverage from the interior storage tank; a plurality of domes; and a plurality of dome lights arranged around a base of each dome, the plurality of dome lights are configured to illuminate the layer of frost on the domes and the mounting rail; wherein the top rail plate and dome plate are made of a metal having a first thermal conductivity factor; and wherein the rail freezing and chilling mechanism includes: a first non-metallic thermal layer immediately below the top rail plate; a metal thermal conductor layer made of a metal with a second thermal conductivity factor greater than the first thermal conductivity factor below the first non-metallic thermal layer; a second non-metallic thermal layer below the metal thermal conductor layer; and at least one refrigerant line partially or fully embedded within the second non-metallic thermal layer, the at least one refrigerant line being configured to flow therethrough a refrigerant.

2. The device according to claim 1, further comprising a beer dispensing tower coupled to said mounting rail.

3. The device according to claim 2, wherein the beer dispensing tower comprises a tower body wherein the tower body is configured to form a layer of frost on the tower body.

4. The device according to claim 1, wherein the dome has a pyramid shape, a spherical shape, circular shape, or cylindrical shape.

5. The device according to claim 1, wherein the dome comprises a stabilizing bar mounted to a floor of the interior storage tank, the stabilizing bar being constructed and arranged to be received in an opening and neck of the bottle and stabilize said bottle.

6. The device according to claim 1, wherein the dome freezing and chilling mechanism includes:

a first non-metallic thermal layer immediately concentric with the dome plate;

a metal thermal conductor layer made of a metal with a third thermal conductivity factor greater than the first conductivity factor adjacent to and concentric with the first non-metallic thermal layer;

a second non-metallic thermal layer adjacent to and concentric with the metal thermal conductor layer; and at least one refrigerant line partially or fully embedded within the second non-metallic thermal layer, the at least one refrigerant line being configured to flow therethrough a refrigerant.

7. The device according to claim 1, further comprising:

first and second elongated heating wires enclosed along longitudinal sides of the mounting rail; and a temperature control unit configured to control heat along each of the elongated heating wires to minimize condensation.

8. A system for chilling and dispensing a beverage from a bottle comprising: a chilling and frost system having a compressor and refrigerant; a mounting rail configured to attach to a bar top structure and having a top rail plate and a rail freezing and chilling mechanism under the top rail plate, the rail freezing and chilling mechanism configured to receive said refrigerant; a dome configured to attach to the top rail plate and having a dome plate, interior storage tank and a dome freezing and chilling mechanism between the dome plate and the interior storage tank, the dome freezing and chilling mechanism configured to receive said refrigerant; wherein the rail freezing and chilling mechanism and the dome freezing and chilling mechanism are configured to build a layer of frost on top of the top rail plate and along the dome plate from humidity of ambient air and the dome is configured to seat the bottle in an inverted position and chill and dispense the beverage from the interior storage tank; a plurality of domes; and a plurality of dome lights arranged around a base of each dome, the plurality of dome lights are configured to illuminate the layer of frost on the domes and the mounting rail; wherein the top rail plate and dome plate are made of a metal having a first thermal conductivity factor; and wherein the rail freezing and chilling mechanism includes: a first non-metallic thermal layer immediately below the top rail plate; a metal thermal conductor layer made of a metal with a second thermal conductivity factor greater than the first thermal conductivity factor below the first non-metallic thermal layer; a second non-metallic thermal layer below the metal thermal conductor layer; and at least one refrigerant line partially or fully embedded within the second non-metallic thermal layer, the at least one refrigerant line being configured to flow therethrough a refrigerant.

9. The system according to claim 8, further comprising a beer dispensing tower coupled to said mounting rail; and a beer chilling system having a coolant.

10. The system according to claim 9, wherein the beer dispensing tower comprises a tower body wherein the tower body is configured to form a layer of frost on the tower body using the coolant from the beer chilling system.

11. The system according to claim 8, wherein the dome has a pyramid shape, a spherical shape, circular shape, or cylindrical shape.

12. The system according to claim 8, wherein the dome comprises a stabilizing bar mounted to a floor of the interior storage tank, the stabilizing bar being constructed and arranged to be received in an opening and neck of the bottle and stabilize said bottle.

13. The system according to claim 8, wherein the dome freezing and chilling mechanism includes:

a first non-metallic thermal layer immediately concentric with the dome plate;

a metal thermal conductor layer made of a metal with a third thermal conductivity factor greater than the first conductivity factor adjacent to and concentric with the first non-metallic thermal layer;

a second non-metallic thermal layer adjacent to and concentric with the metal thermal conductor layer; and at least one refrigerant line partially or fully embedded within the second non-metallic thermal layer, the at least one refrigerant line being configured to flow therethrough said refrigerant.

14. The system according to claim 8, further comprising:

first and second elongated heating wires enclosed along longitudinal sides of the mounting rail; and a temperature control unit configured to control heat along each of the elongated heating wires to minimize condensation.

* * * * *